US012667207B2

(12) United States Patent
Keenan

(10) Patent No.: US 12,667,207 B2
(45) Date of Patent: Jun. 30, 2026

(54) WALL STORAGE SYSTEM

(71) Applicant: JBK Studios, Inc., Mequon, WI (US)

(72) Inventor: John Keenan, Mequon, WI (US)

(73) Assignee: JBK Studios, Inc., Mequon, WI (US)

( * ) Notice: Subject to any disclaimer, the term of this patent is extended or adjusted under 35 U.S.C. 154(b) by 0 days.

(21) Appl. No.: 18/954,886

(22) Filed: Nov. 21, 2024

(65) Prior Publication Data

US 2025/0204702 A1 Jun. 26, 2025

Related U.S. Application Data

(60) Provisional application No. 63/601,436, filed on Nov. 21, 2023.

(51) Int. Cl.
*A47F 5/08* (2006.01)
*A47F 5/00* (2006.01)

(52) U.S. Cl.
CPC ..... *A47F 5/0853* (2013.01); *A47F 5/0006* (2013.01)

(58) Field of Classification Search
CPC .... A47F 5/0853; A47F 5/0006; A47F 5/0846; A47B 96/067; A47B 96/1416; A47B 57/06; A47B 95/008; A47B 96/1408; A47B 96/027; A47B 2097/003
See application file for complete search history.

(56) References Cited

U.S. PATENT DOCUMENTS 4,674,240 A * 6/1987 Strausheim ..... A47F 5/0846 52/542
5,121,578 A * 6/1992 Holz ..... E04B 9/26 52/510
5,390,462 A * 2/1995 Kreiter ..... E04F 21/0069 52/506.01
5,412,912 A * 5/1995 Alves ..... A47F 5/0846 52/36.5
5,477,645 A * 12/1995 Bauer ..... A47F 5/0846 52/146
5,941,026 A * 8/1999 Eisenreich ..... A47F 5/0846 52/12
6,134,846 A * 10/2000 Lamb ..... A47F 5/0846 52/36.5
7,900,781 B2 * 3/2011 Baine ..... A47F 5/0838 211/106.01
8,056,739 B2 * 11/2011 Hopkins ..... A47F 5/0846 52/36.5

(Continued)

*Primary Examiner* — Ko H Chan
(74) *Attorney, Agent, or Firm* — Boyle Fredrickson, S.C.

(57) ABSTRACT

A wall storage system is provided including at least one decorative, durable wall panel, at least one mounting member engageable with the at least one wall panel and adapted to be secured to a wall surface, and an alignment device adapted to align the at least one mountain member on the wall surface. The wall storage system can additionally include an article holder including a releasable securing mechanism engageable with the at least one wall panel to secure the article holder to the at least one wall panel, and a decorative finish or panel disposed on at least a portion of the at least one wall panel, providing customizable aesthetic options and enhanced durability. This system enables flexible configurations, easy installation, and a tamper-resistant securing mechanism for organized and accessible storage solutions.

6 Claims, 29 Drawing Sheets

(56) References Cited

U.S. PATENT DOCUMENTS

| | | | | |
|---|---|---|---|---|
| 8,267,363 | B2 * | 9/2012 | Begic | F16M 13/02 248/221.11 |
| 8,746,472 | B2 * | 6/2014 | Thrush | A47B 96/067 211/94.01 |
| 9,902,589 | B2 * | 2/2018 | Gregory | B65H 54/585 |
| 10,088,097 | B2 * | 10/2018 | Hermey | H02G 3/263 |
| 10,492,631 | B2 * | 12/2019 | Velderman | A47F 5/0853 |
| 11,939,776 | B2 * | 3/2024 | Letham | E04F 13/12 |
| 12,295,506 | B2 * | 5/2025 | Paprocki | B25H 5/00 |
| 2009/0134290 | A1 * | 5/2009 | Begic | F16M 13/02 248/225.11 |
| 2009/0145867 | A1 * | 6/2009 | Apgood, II | A47F 5/0846 211/94.01 |
| 2010/0300999 | A1 * | 12/2010 | Schwartzkopf | A47F 5/101 211/104 |

* cited by examiner

FIG. 4H
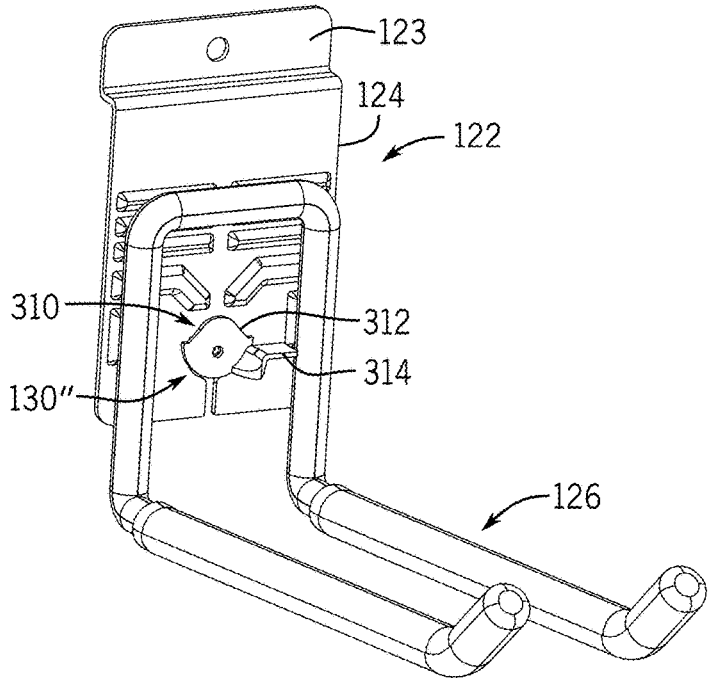
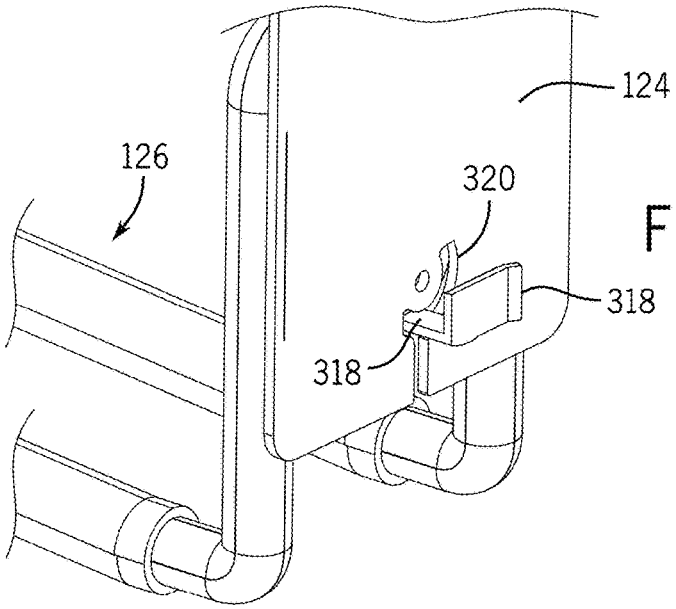
FIG. 4I
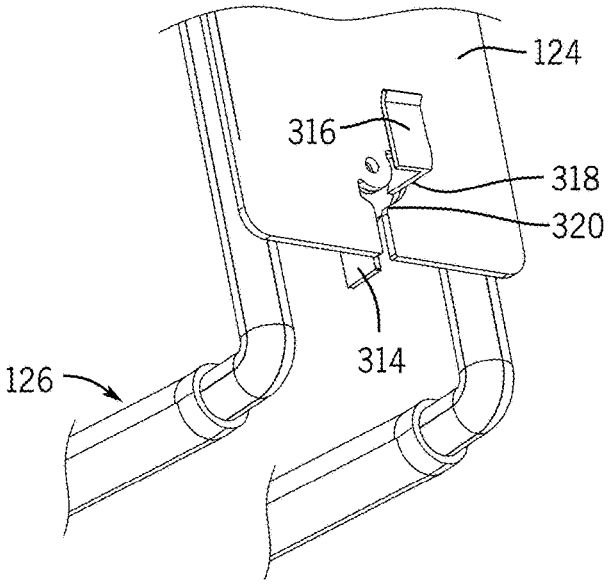
FIG. 4J

WALL STORAGE SYSTEM

CROSS-REFERENCE TO RELATED APPLICATIONS

The present application claims priority from U.S. Provisional Patent Application Ser. No. 63/601,436, filed on Nov. 21, 2023, the entirety of which is expressly incorporated herein by reference for all purposes.

FIELD OF THE INVENTION

The present invention relates generally to storage systems, and more specifically to improved storage systems for use on walls, with particular emphasis on durable and versatile configurations optimized for garages, workshops, and other non-climate controlled and/or high-utility environments.

BACKGROUND OF THE INVENTION

In the area of wall storage systems, the primary purpose of the systems is to provide easily accessible and/or viewable storage for the items to be placed on the wall storage system. As virtually any type of item can be placed on the system for storage purposes due to the large variety of implements that can be attached to the storage system for holding items thereon, wall storage systems have gained widespread acceptance.

To secure the storage system to the wall, it is necessary to position the storage system horizontally on the wall in a level configuration. This enables the storage system to securely engage and hold the items on the storage system using the various implements engaged between the storage system and the items.

To secure the storage system on the wall in the proper configuration, the system includes brackets that are secured to the wall and that engage recesses on the rear of the storage system panels in order to engage and hold the panels with the wall.

However, one significant issue with regard to these types of storage systems is their installation in the level horizontal position using the brackets. As the brackets are mounted to the wall, it is difficult to view the securement of the wall storage system panels on the bracket. Additionally, due to the configuration of the brackets, often the individual brackets are not level with a horizontal line or with one another. As a result, often times the wall storage system can be mounted to the wall in a non-level position, creating problems with the proper operation of the wall storage system.

Another significant limitation of current wall storage systems lies in their lack of secure and reliable locking mechanisms for attached items. While the various article holders, hooks, supports and other implements for the items to be displayed on the storage system can be readily engaged in the gap formed between adjacent panels of the storage system panel, there are presently a lack of easily engageable devices for securely locking the article holders on the panel. This limitation often results in accidental dislodgement or misalignment of stored items, particularly under heavy load or vibration.

Further, while prior art storage system panels are formed with the panels of a suitable material, typically medium density fiberboard (MDF) or basic extruded PVC, the slots located between the panels are formed such that the panels must be installed in a certain orientation on the wall. Further, the panels are exclusively formed of the material forming the panel, thus limiting the aesthetic appearances that can be provided by the panels when mounted to a wall. For instance, standard MDF-based panels can degrade under high-moisture conditions, while extruded PVC panels often lack aesthetic sophistication.

Therefore, it is desirable to develop an improved wall storage system to address these issues with the prior art, by providing a wall storage system that offers enhanced installation ease, durability, secure attachment mechanisms, and expanded aesthetic choices suitable for both residential and commercial environments.

SUMMARY OF THE DISCLOSURE

According to one aspect of an exemplary embodiment of the disclosure, a wall storage system is configured with a slatwall panel that is to be secured to a wall. The slatwall panel is formed of a durable, water-resistant material, such as PVC or a wood plastic composite (WPC) material, and includes a number of elongate horizontal slots disposed between flat sections of the slatwall panel. The slots have a configuration that enables the panels to be mounted in a reversible manner to position the slots in a horizontal orientation relative to the wall on which the panel is secured.

According to another exemplary aspect of the disclosure, various article holders or supports can be engaged within the slots to hold the support on the panel without the need for any additional engagement members or structures, thereby providing an easy to assemble construction. The supports have a number of different options for locking mechanisms to maintain the article holders securely on the slatwall panel. These locking mechanisms minimize accidental dislodgement or shifting, even under load or vibration.

According to still another exemplary aspect of the present disclosure, the slatwall panels incorporate decorative elements. With the formation of the slatwall panels in a machined manner to form the slots therein, a laminated and/or textured decorative finish or layer can be positioned on each of the flat sections of the slatwall panels between the slots to provide an enhanced aesthetic appearance to the slatwall panel. This design allows for a range of finishes, including woodgrain, metallic, and customized digital patterns, enabling greater design flexibility for residential, commercial, and industrial applications.

The panel additionally includes a number of recesses disposed on the rear surface of the panels that are configured to receive teeth of a mounting member that is secured on the wall to which the panel is to be secured. The mounting members are secured in a horizontal and level configuration by securing a number of specialized alignment devices therebetween to enable the mounting brackets to quickly and easily be placed in the proper configuration on the wall for mounting the panels thereto in the desired configuration. This hidden fastener system ensures a secure, visually unobtrusive installation that remains consistently level, minimizing installation errors.

These and other aspects, features and advantages of the invention will be made apparent from the following detailed description taken together with the drawing figures.

BRIEF DESCRIPTION OF THE DRAWINGS

The drawings illustrate the best mode currently contemplated of practicing the present invention.

In the drawings:

FIGS. 3A-3L are various views of a second embodiment of a locking mechanism for an article holder according to the present disclosure;

DETAILED DESCRIPTION OF THE DRAWINGS

Before the present compositions, apparatuses and methods are described, it is understood that this invention is not limited to the particular embodiments and methodology, as these may vary. It is also to be understood that the terminology used herein is for the purpose of describing particular exemplary embodiments only, and is not intended to limit the scope of the present invention which will be limited only by the appended claims.

Figure 1:
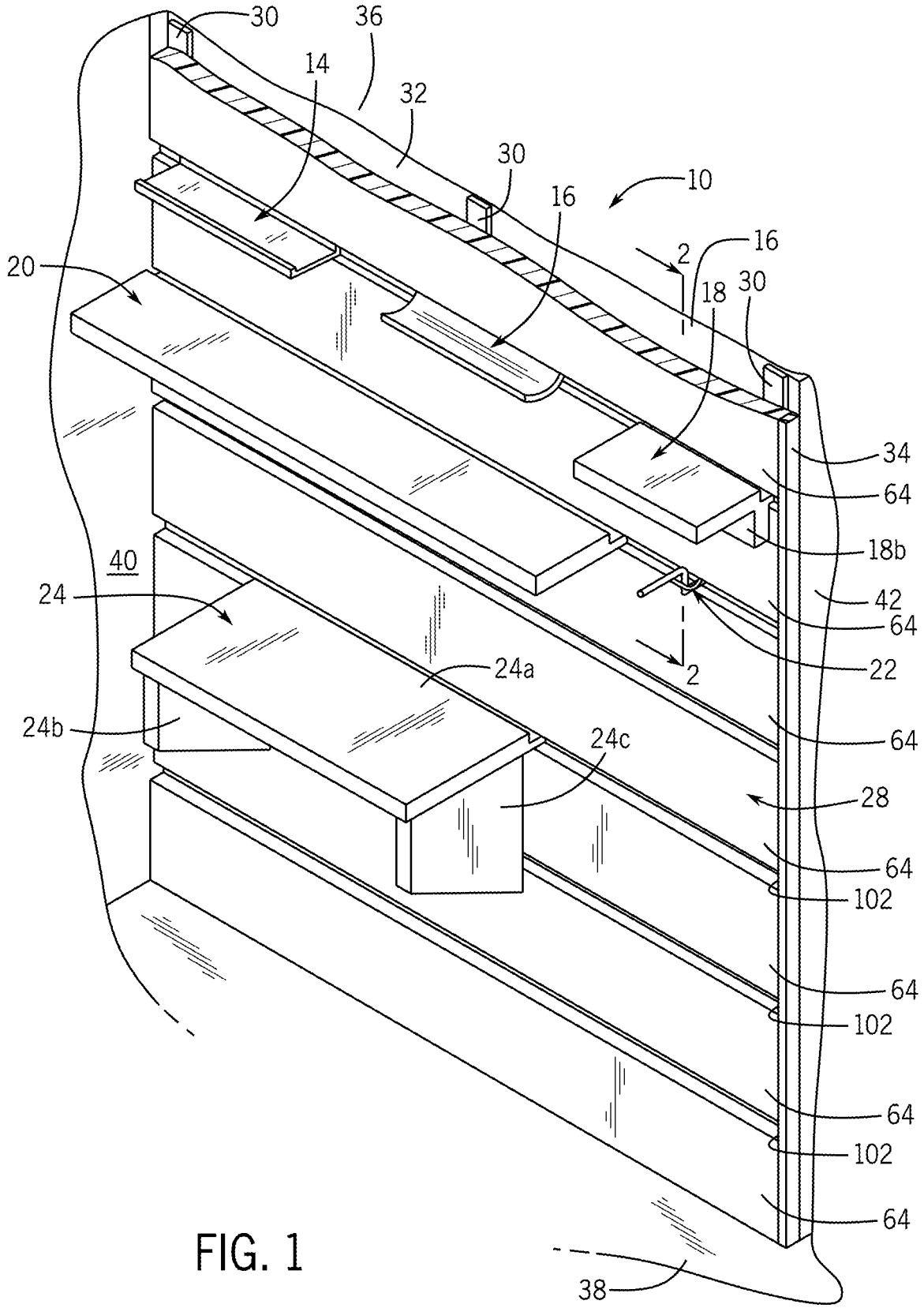
FIG. 1 is an isometric view of one embodiment of the slatwall storage system of the invention.
Figure 2A:
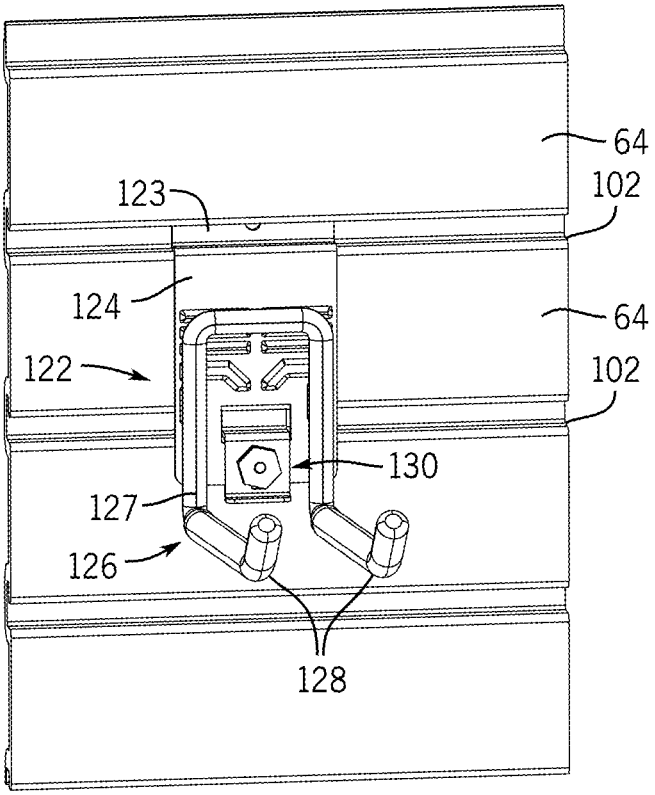
FIGS. 2A-2J are various views of a first embodiment of a locking mechanism for an article holder according to the present disclosure.
Figure 2B:
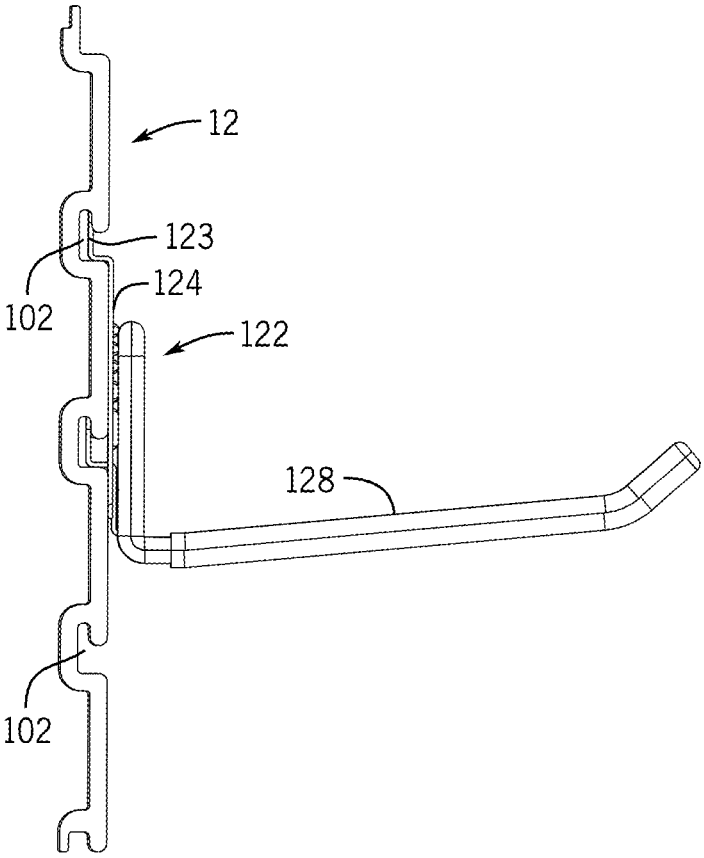
Figure 2C:
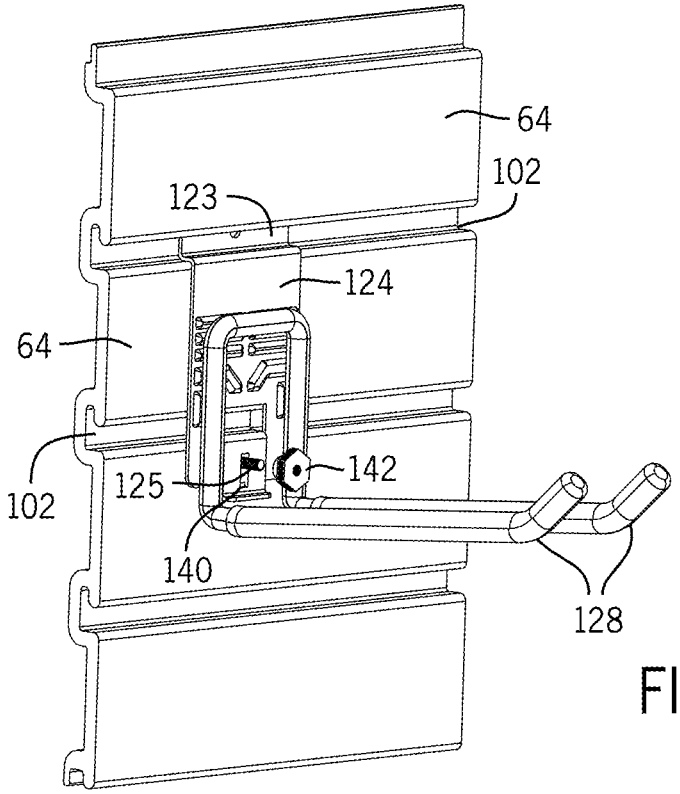
Figure 2D:
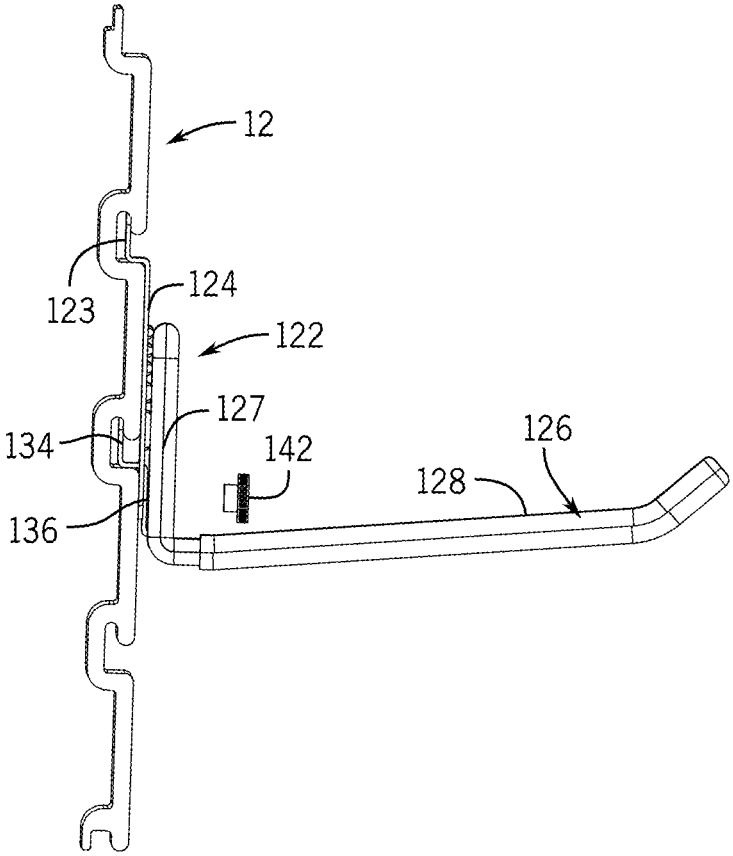
Figure 2E:
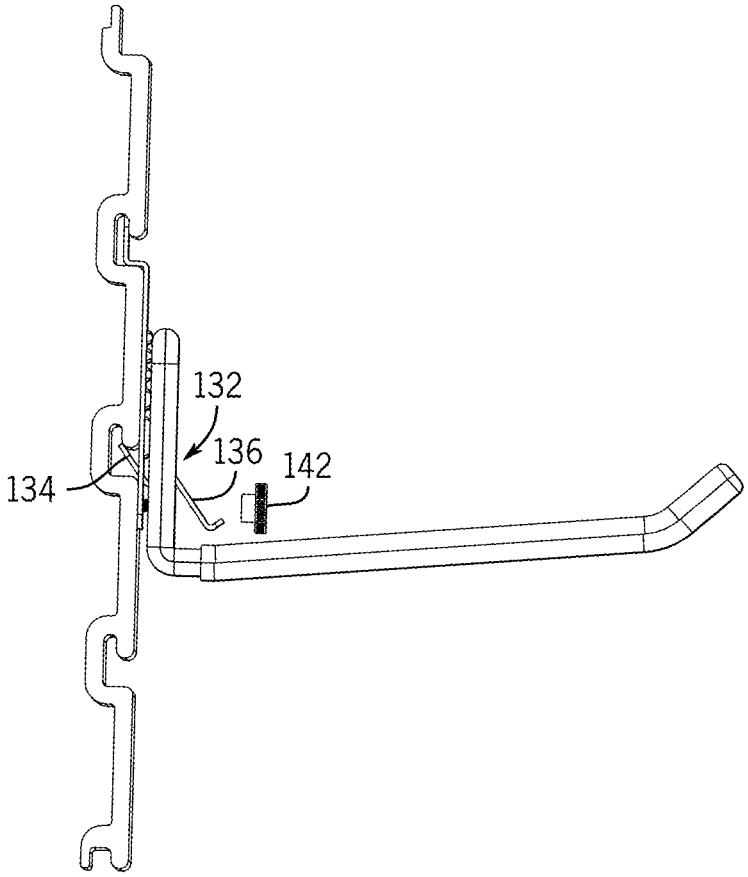
Figure 2F:
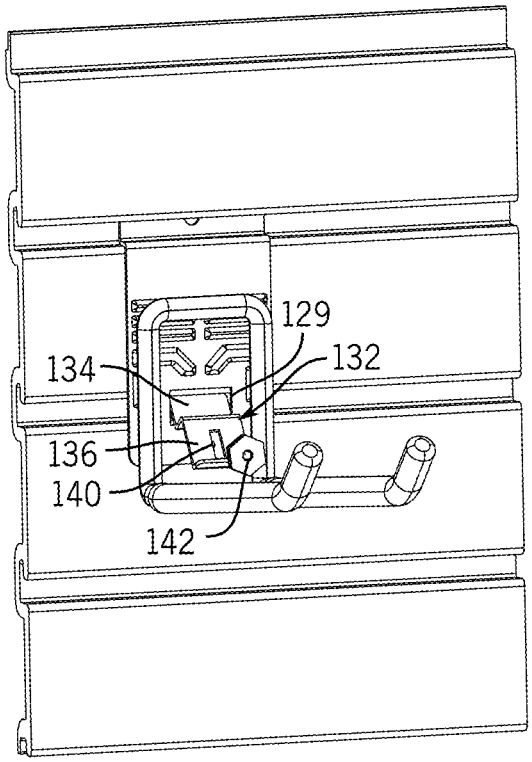
Figure 2G:
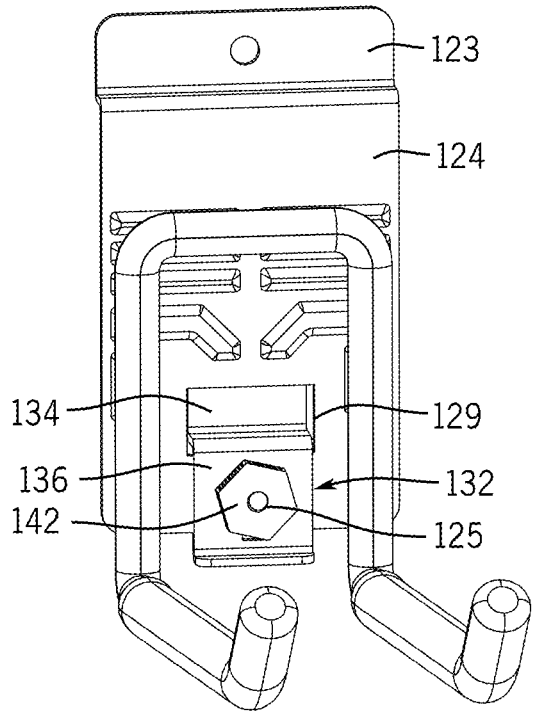
Figure 2H:
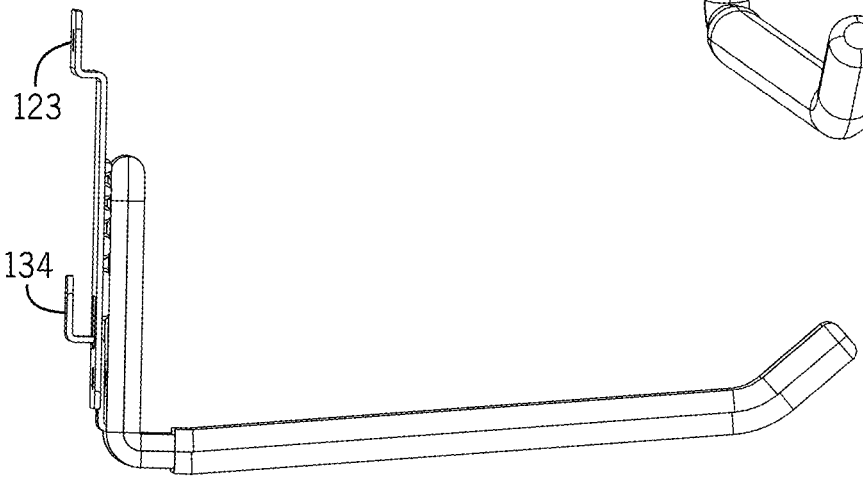
Figure 2I:
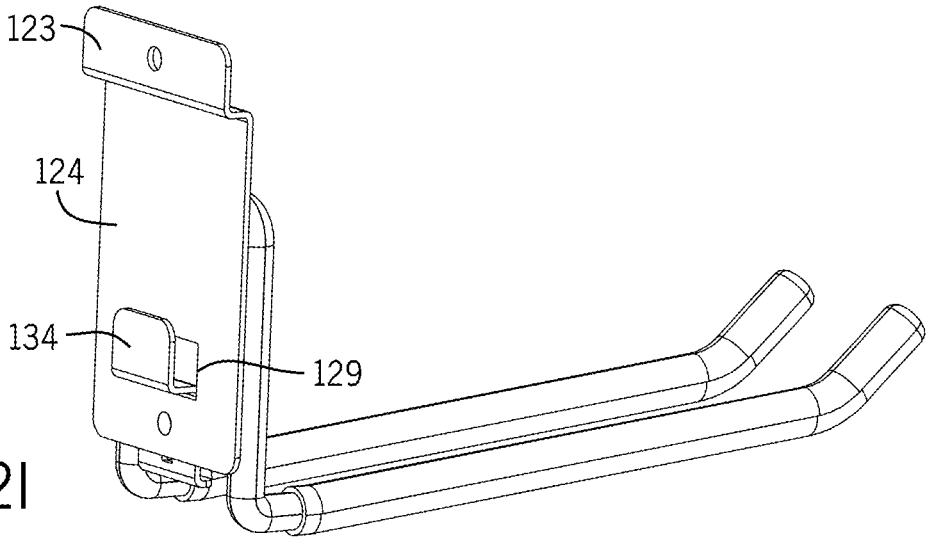
Figure 2J:
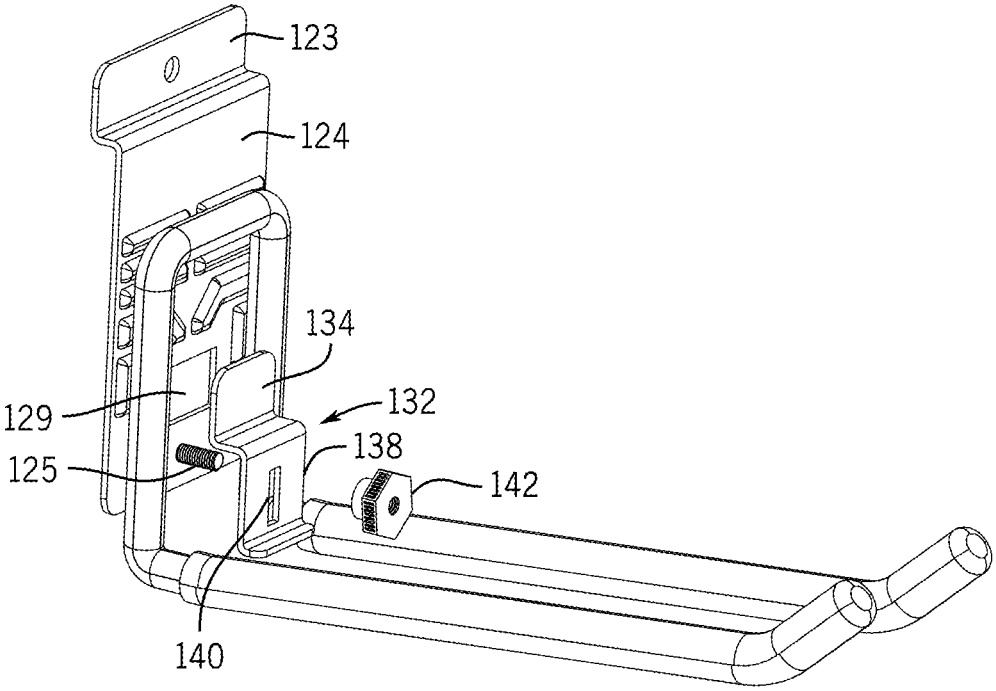
Figure 6A:
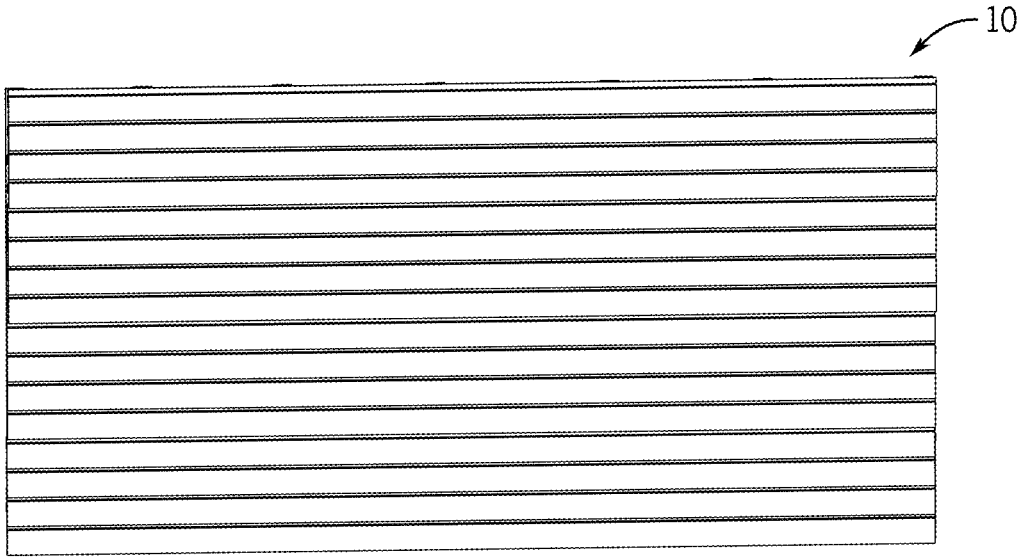
FIGS. 6A-6K are various views of an exemplary embodiment of a mounting mechanism for slatwall panels according to the present disclosure including the hidden fastener system with recesses on the rear of the panels that engage mounting members affixed to the wall, ensuring level and secure panel alignment.
Figure 6B:
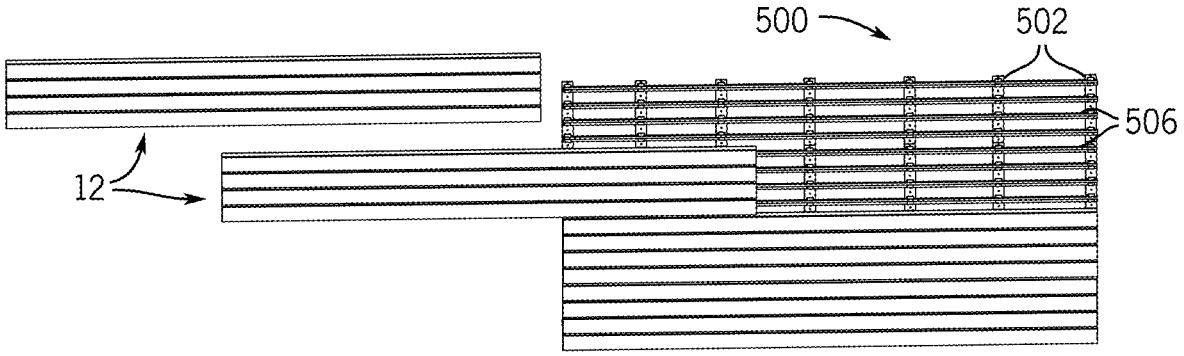
Figure 6C:
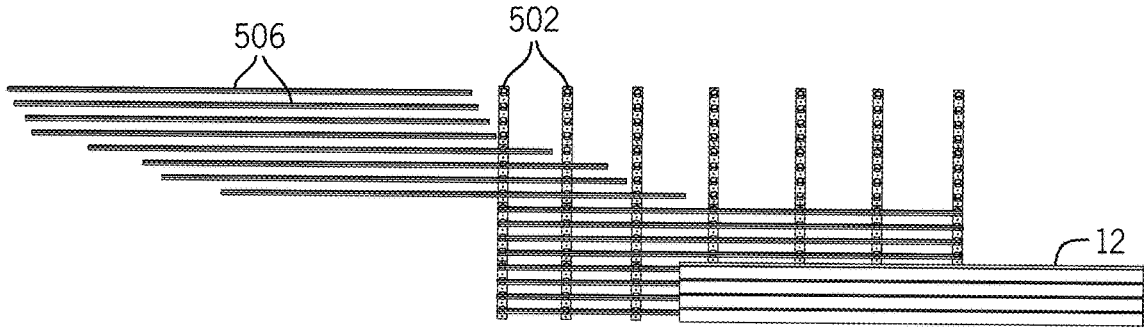
Figure 6D:
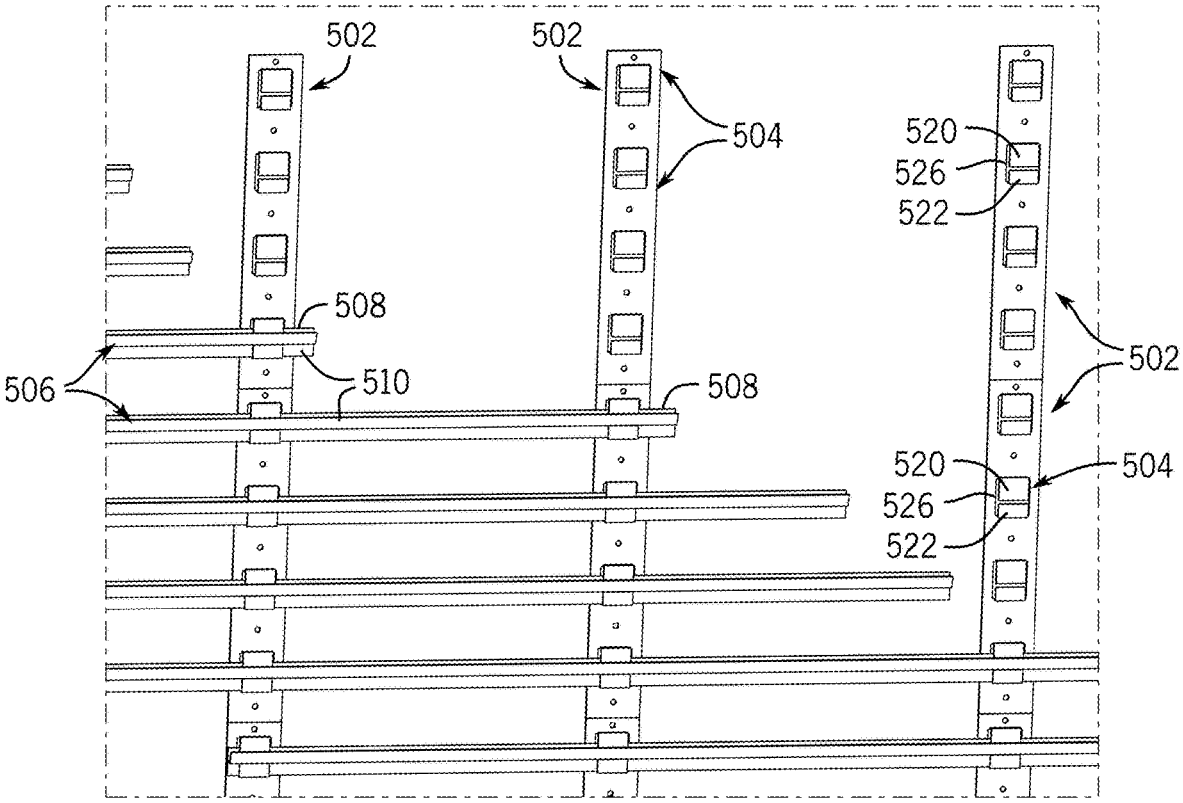
Figure 6E:
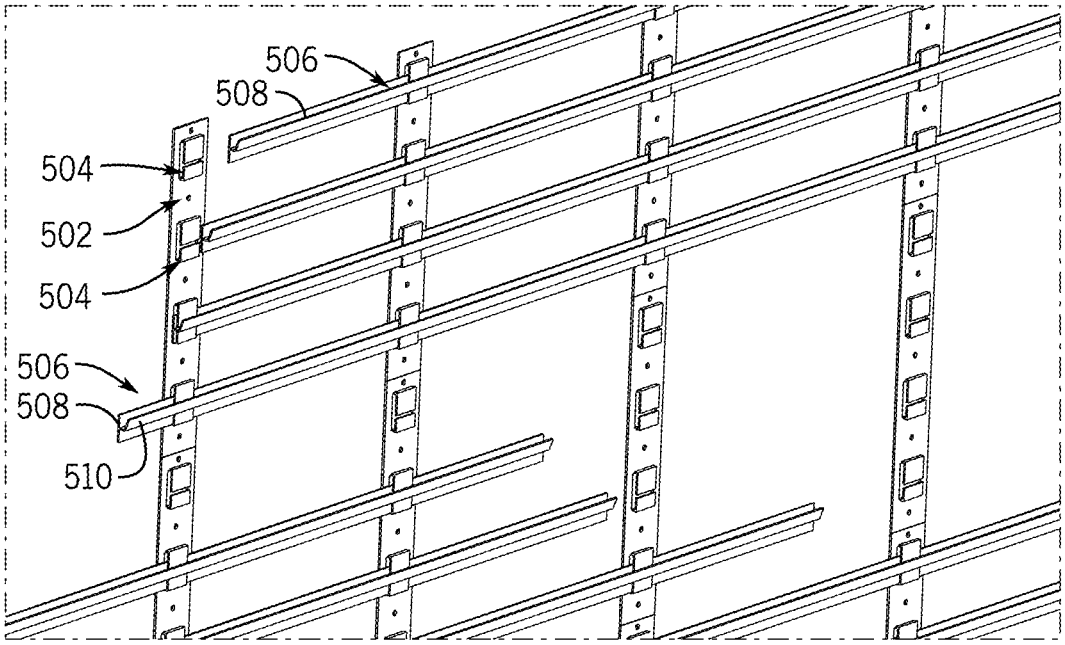
Figure 6F:
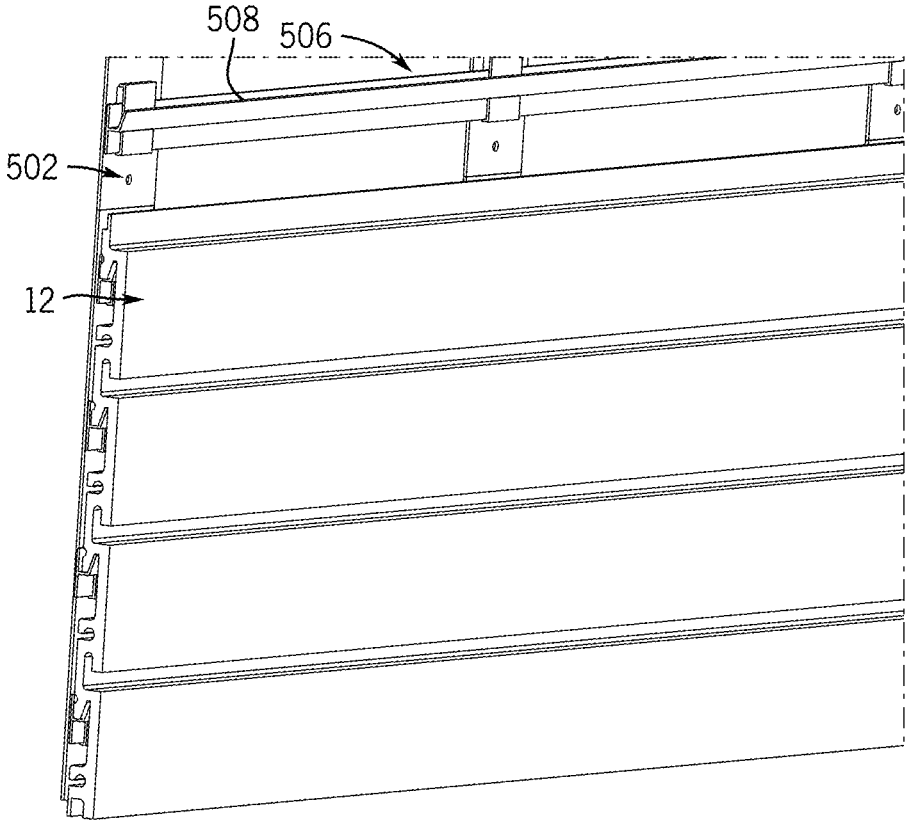

Referring now to FIG. 1, the reference numeral 10 generally identifies the slatwall display system constructed in accordance with the principles of the invention for supporting and displaying various types of article holders 14, 16, 18, 20, 22, and 24 from a front side thereof. The system 10 can have any desired configuration, but in one exemplary embodiment the system 10 has a configuration corresponding to the panel disclosed in U.S. Pat. No. 5,941,026, entitled Slatwall Display System, which is hereby expressly incorporated by reference for all purposes. In the exemplary illustrated embodiment of FIGS. 1 and 6B-6C, the system 10 is comprised of a series of horizontally disposed, generally rectangular slat panels 12 juxtaposed and interconnected together, one atop the other, at slatwall panel joints 26 to form a slat panel assembly 28. The slat panel assembly 28 is supported on a set of vertically extending mounting members 30 rigidly anchored to a vertical wall 32. Both slat panels 12 and mounting members 30 are substantially rigid elements and can be formed of suitable rigid materials, such as a metal or a hard plastic that are capable of being utilized in exterior environments due to their resistance to moisture and weather damage and impact resistance, such as extruded polyvinylchloride (PVC). In an exemplary embodiment, the density of the material used to form the panels 12, e.g., the PVC, is at least about 0.3 g/cm$^3$, and more particularly between about 0.6 g/cm$^3$ and about 0.9 g/cm$^3$ in order to provide the necessary rigidity to the panel 12 without making the panel 12 too heavy from mounting to a vertical surface or wall. In another exemplary embodiment, the density of the material forming the panel 12 is selected to be about 0.7 g/cm$^3$.

In one exemplary embodiment, the panels 12 are formed in an extrusion process where the thickness of the panel 12 is determined to be between about 12 mm and about 20 mm, with a preferred thickness of about 16 mm. After extrusion, in one embodiment the panels 12 can be cut into a desired shape for use, such as a rectangular shape with dimensions of between about 1 foot to about 6 feet in height and from about 2 feet to about 14 feet in length, with a shape of about 4 feet in height and about 8 feet in length being preferred. In addition, the panels 12 can be formed with a flat back or rear surface, which enhances the rigidity and strength of the panel 12.

It should be appreciated from the outset of this description that the slat panel assembly 28 could also be mounted on a free-standing vertical wall which could carry the slat panels on one or both sides thereof as desired by the user. Likewise, it should be understood that while the article holders 14-24 are preferably shown as shelves and a hanger, the slatwall panel assembly 28 is equally capable of supporting other article holders such as baskets, trays, brackets, lights, etc.

Figure 7:
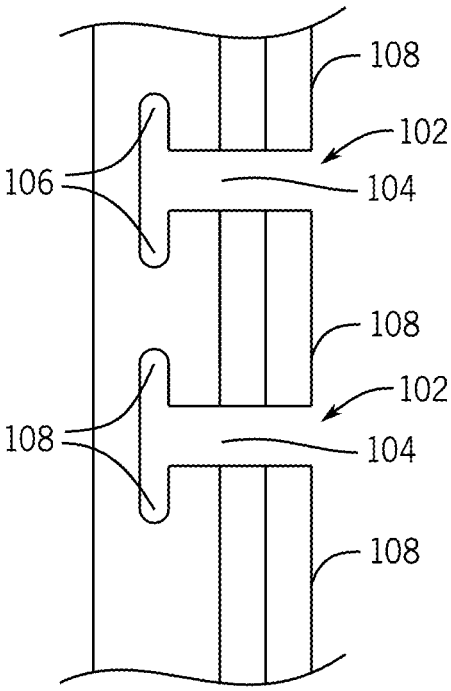
FIG. 7 is an isometric view of an exemplary embodiment of a slatwall panel according to the disclosure, demonstrating the decorative laminate panels, slot configuration, and panel profile designed for durability and enhanced aesthetic appeal.
Figure 8:
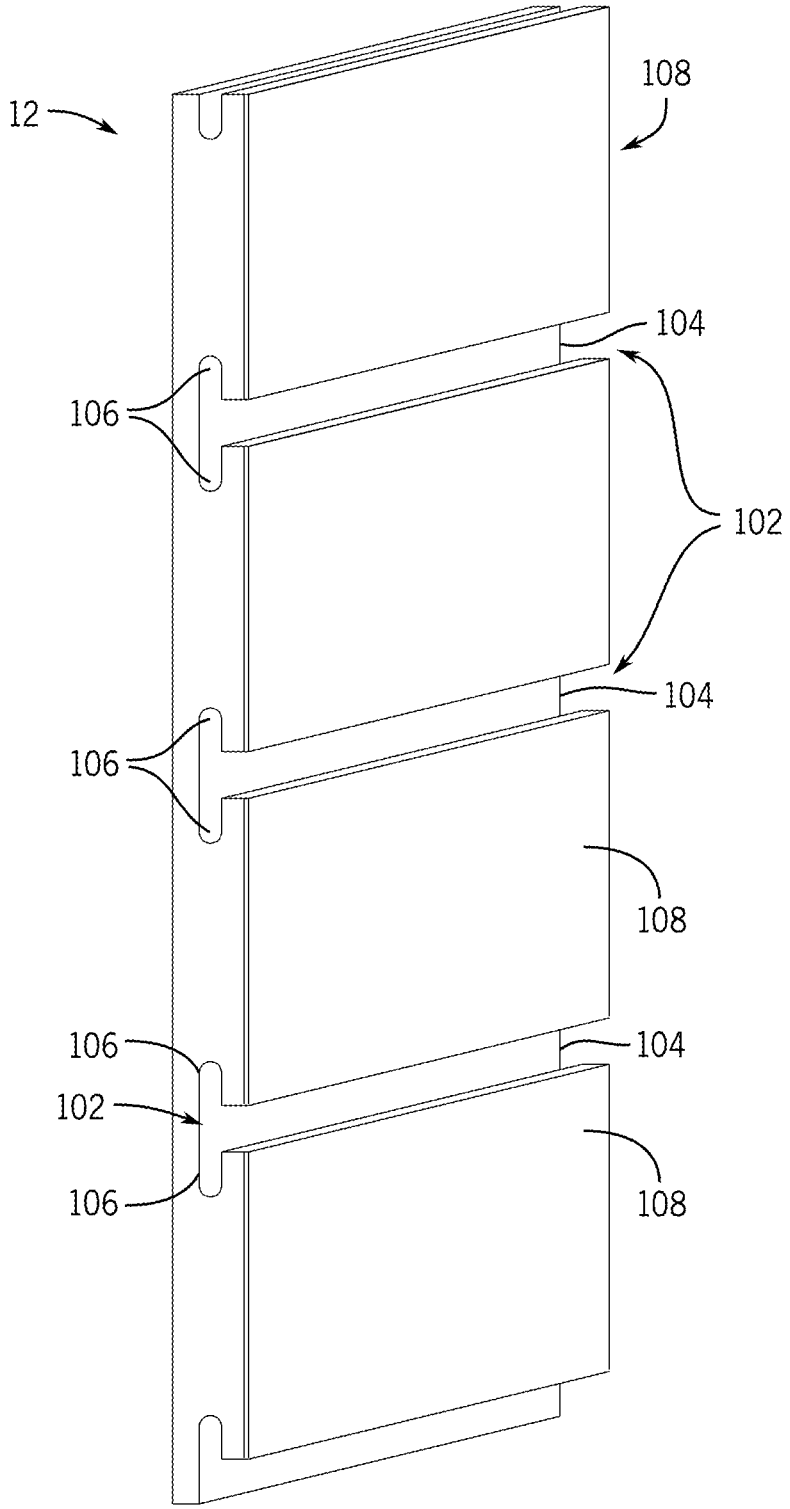
FIG. 8 is an isometric view of another exemplary embodiment of a slatwall panel according to the disclosure, illustrating alternative decorative and/or structural configurations, such as custom finishes or additional slot orientations, for increased versatility.

With reference now to FIGS. 1, 7 and 8, the slatwall panel 12 includes a number of flat sections 64 separated by horizontal slots 102. In this and in conjunction with any other embodiments of the panel 12 and attachments or mounting structures disclosed herein, the slots 102 are shaped with a central portion 104 that extends inwardly into the panel 12 and a pair of lateral sections 106 extending perpendicularly within the panel 12 from each side of the central portion 104. In the illustrated exemplary embodiment the lateral sections 106 are formed to be identical to one another such that the orientation of the panel 12 provides the same orientation for the lateral section 106, such that the panel 12 can be mounted to the wall and/or any attachments (e.g., article holder 122) mounted to the panel 12 within the slots 102 can be in a reversible manner as opposed to prior art panels including L-shaped slots that allowed for mounting to the L-shaped slots in only one manner or direction.

In addition, the flat sections 64 each include a decorative laminate panel or cover 108 positioned thereon between the slots 102. The cover 108 can be formed of any suitable real or fake material, such as a metal, wood, stone, etc., and in one particular exemplary embodiment, of a PVC material having a high-quality laminate finish to achieve the desired aesthetic appearance and/or texture, to provide the desired aesthetic appearance to the slatwall panel 12. In a particular exemplary embodiment, as shown in FIG. 7 a notable aspect of the present disclosure involves machining the slatwall panels 12 to create the slots 102, such as by milling the slots 102 out of a unitary piece of the material forming the panels 12 in order to decrease the complexity of manufacturing the panels 12 while also allowing for the placement of decorative panels 108 on the flat sections 64 between the slots 102. This enhances the overall aesthetic appeal of the slatwall panel 12, enabling customization of the appearance of the panel 102 as desired without increasing production complexity or costs of the construction and/or manner of forming the individual panels 12.

In one exemplary embodiment, the decorative panel 108 is formed with a thickness of between about 0.1 mm to about 2.5 mm, with a thickness of about 0.5 mm being preferred. The decorative panel 108 can be applied to the panel 12 after extrusion and prior to the machining of the slots 102 in the panel 12. In this manner, the slots 102 extend through the decorative panel 108 placed on the extruded panel 12.

Alternatively, the decorative panels 108 can be formed to match the dimensions of the flat sections 64 and can be placed on the flat section 64 between the slots 102 after machining the slots 102 in the panel 12. In either embodiment, the decorative panel 108 is attached or secured to the panel 12/flat sections 64 in any suitable manner, such as by adhering, heat sealing or mechanically fastening the decorative cover 108 to the panel 12/flat section 64.

Referring now to FIGS. 2A-2J, a first embodiment of an article holder 122 is illustrated as attached to a portion of the panel 12 including the slots 102 with other portions of the panel 12 removed for ease of viewing. The article holder 122 includes a base plate 124 and a holding member 126 extending outwardly from the base plate 124. The holding member 126 can take a variety of forms, and in the illustrated exemplary embodiment includes a pair of arms 128 spaced from one another and joined to the base plate 124 at one end, e.g., to an arm support 127 attached to the base plate 124. The arms 128 are located parallel to one another such that various items (not shown) can be hung or otherwise engage with one or both of the arms 128 to be supported thereon.

For each of the embodiments of the article holder 122 to be described, the base plate 124 and the holding member 126 can be formed similarly to one another. In each embodiment, the form of the securing member 130 is altered to provide different connections to the panels 12, which can assist in supporting different articles on the article holder 122.

In alternative embodiments, the holding member 126 can be formed with the pair of arms 128 separately attached directly to the base plate 124. Also, in other alternative embodiments, a single arm 128 or more than two arms 128 can be attached to the base plate 124 to provide alternative supporting configurations for the article holder 122. Further, the arms 128 can each include various structures of features (not shown) thereon, including but not limited to notches, grooves, and ridges, among others, that enable the arms 128 to space items supported thereon at regular intervals along the arms 128.

The base plate 124 also includes a locking flange 123 engageable within a slot 102 disposed adjacent the base plate 124, and a threaded shaft 125 (FIG. 2J) engaged with the base plate 124, such as within an aperture (not shown) disposed between the arms 128. The threaded shaft 125 extends outwardly from the base plate 124 parallel to the arms 128, but optionally with a length that does not obscure any length of the arms 128, i.e., that does not extend beyond the arm support 127. Further, the base plate 124 includes an aperture 129 disposed adjacent the shaft 125.

The base plate 124 also includes a securing mechanism 130 able to secure the base plate 126, and thus the arms 128, to the slatwall panel 12 to be held thereon. The embodiment of the securing mechanism 130 illustrated best in FIGS. 2E-2F and 21-2J includes a securing plate 132 formed with a locking tab 134 at one end, and an engagement plate 136 at the opposite end, the locking tab 134 and engagement plate 136 joined by positioning member 138. The locking tab 134 and engagement plate 136 extend perpendicularly to the positioning member 138 in opposite directions relative to one another. The engagement plate 136 also includes an aperture 140 therein.

To use the securing mechanism 130, initially the locking flange 123 is engaged within a slot 102 to position the base plate 124 flush against a flat section 64 of the panel 12. The locking tab 134 is inserted through the aperture 129 in the base plate 124 and into a slot 102 partially covered by the base plate 124. The securing plate 132 is moved to align the locking tab 134 vertically within a lateral section 106 of the slot 102, and the place the engagement plate 136 flush against the base plate 124. The positioning of the engagement plate 136 against the base plate 124 locates the shaft 125 within and through the aperture 140, where the shaft 125 can be engaged with a threaded knob 142 to engage the knob 142 with the engagement plate 136 and to secured the engagement plate 136 against the base plate 124. In this configuration the locking tab 134 cannot be disengaged from within the slot 102 without removing the knob 142, such that the base plate 124 is locked to the panel 12, thereby securing the article holder 122 to the panel 12 until the knob 142 is removed.

Referring now to FIGS. 3A-3L, in another illustrated exemplary embodiment of the securing mechanism 130', the mechanism 130' includes a handle 210 including a stem 212 extending outwardly therefrom. The stem 212 extends through an aperture 214 in the base plate 124, which includes a wide upper end 216 and a narrow lower end 218. The stem 212 is inserted through a spring 220 disposed between a stop 222 formed on and extending outwardly from one or both sides of the stem 212 and a locking member 224. The stem 212 is engaged within the locking member 224 to be retained within the locking member 224 but to also be able to slide with respect thereto. The locking member 224 includes a body 226 within which the stem 212 is secured and a locking tab 228 extending outwardly from the body 226. The stem 212 is inserted into the spring 220 within the locking member 224 and the locking member 224 is inserted through the wide end 216 of the aperture 214 in the base plate 124, which allows the stop 222 on the stem 212 to pass through the aperture 214. The handle 210 and the locking member 224 can then be slid towards/into the narrow end 218 to engage the stop 222 with the base plate 124 to or along one side of the narrow end 218 and retain the mechanism 130' on the base plate 124.

Figure 3A:
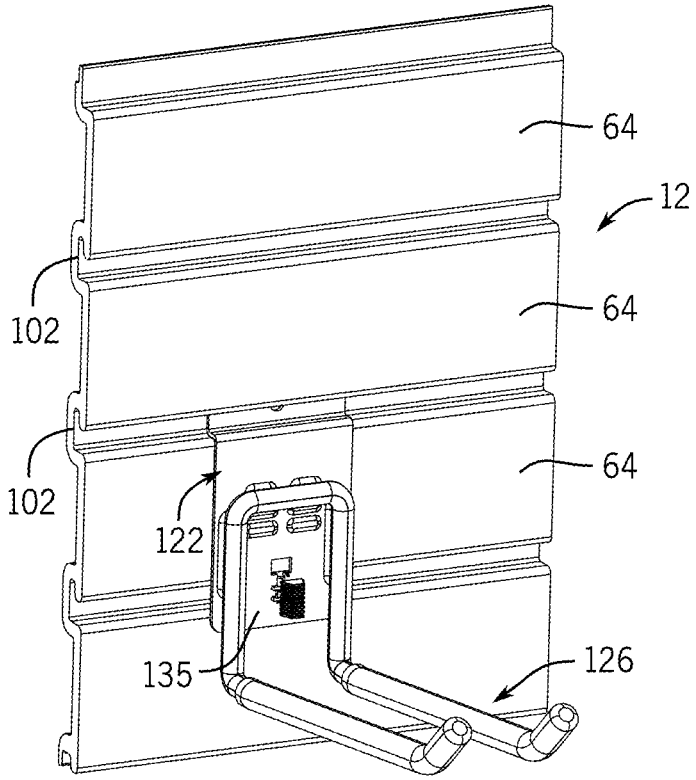
Figure 3B:
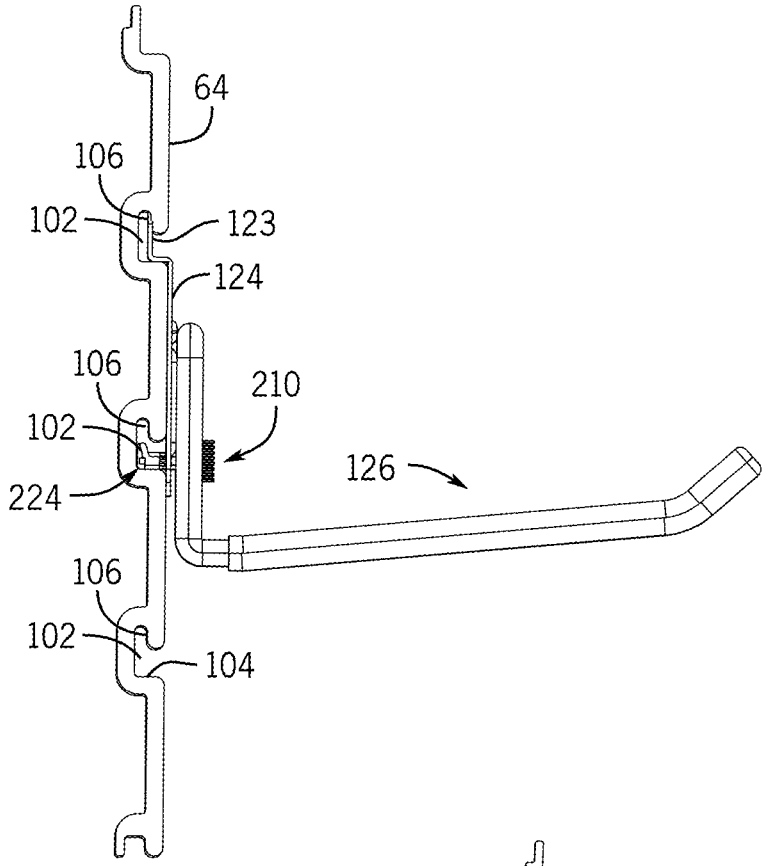
Figure 3C:
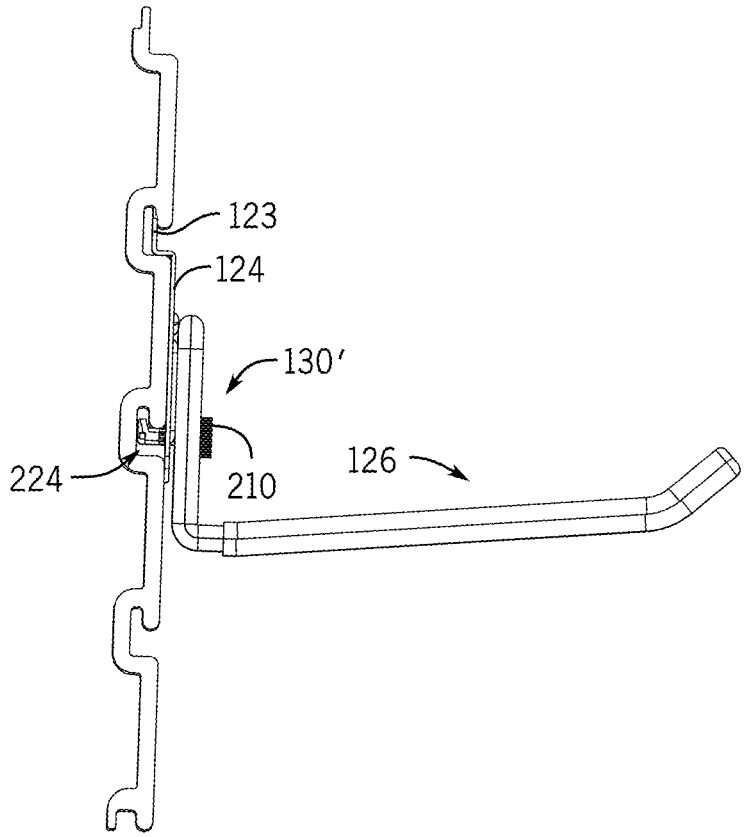
Figure 3D:
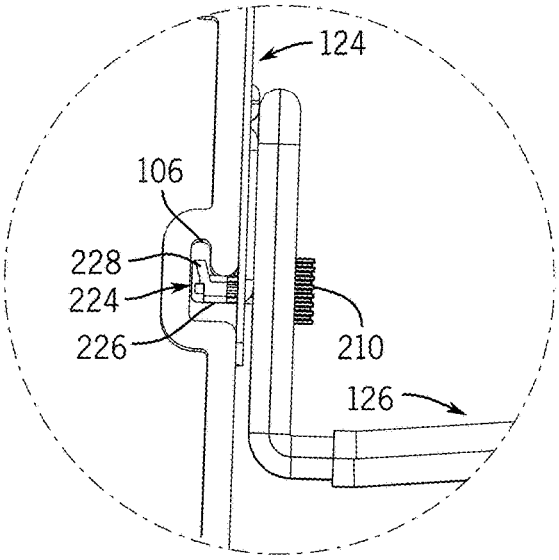
Figure 3F:
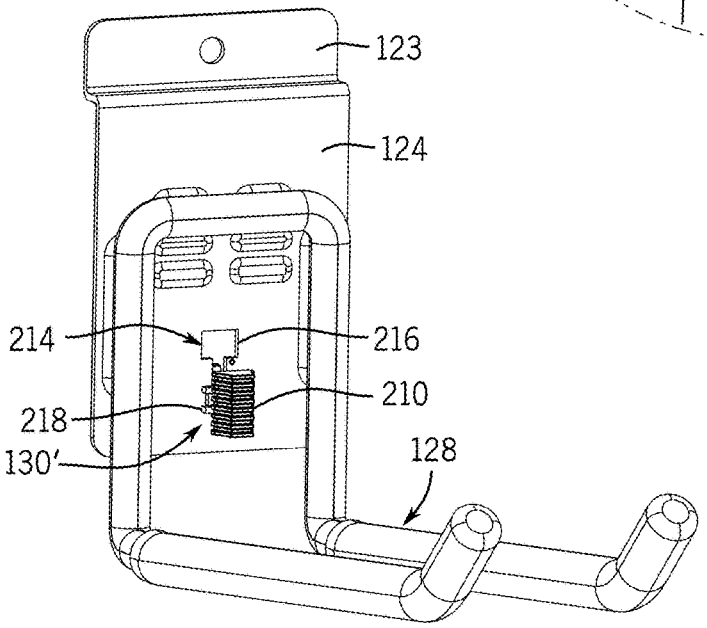
Figure 3G:
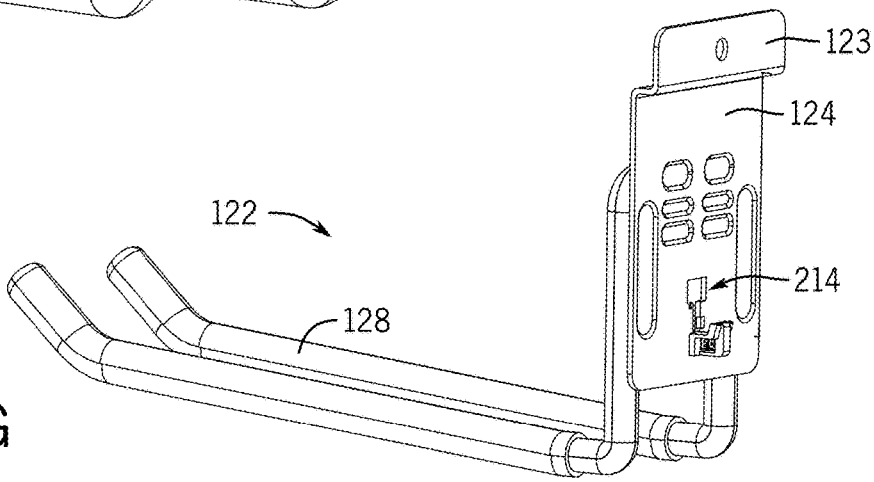
Figure 3H:
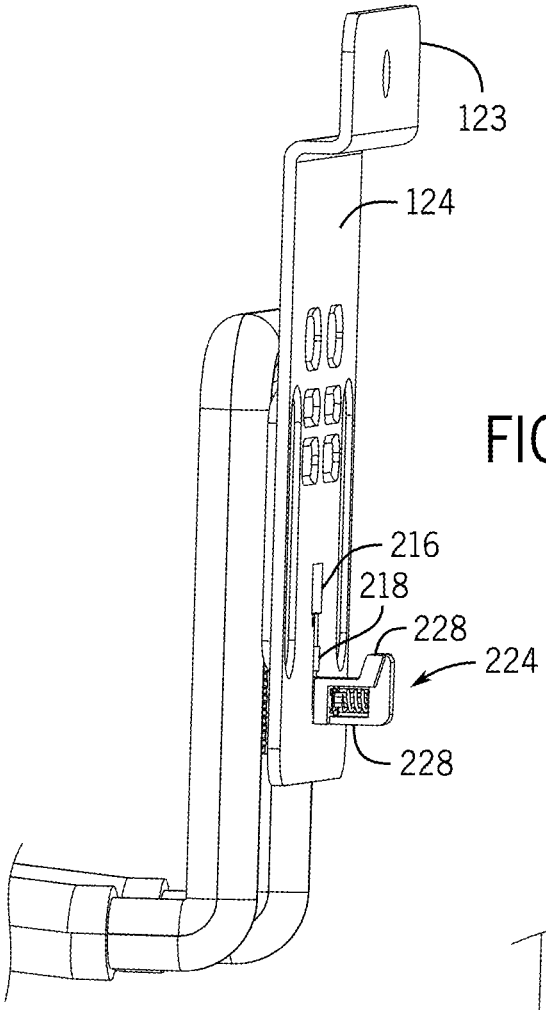
Figure 3I:
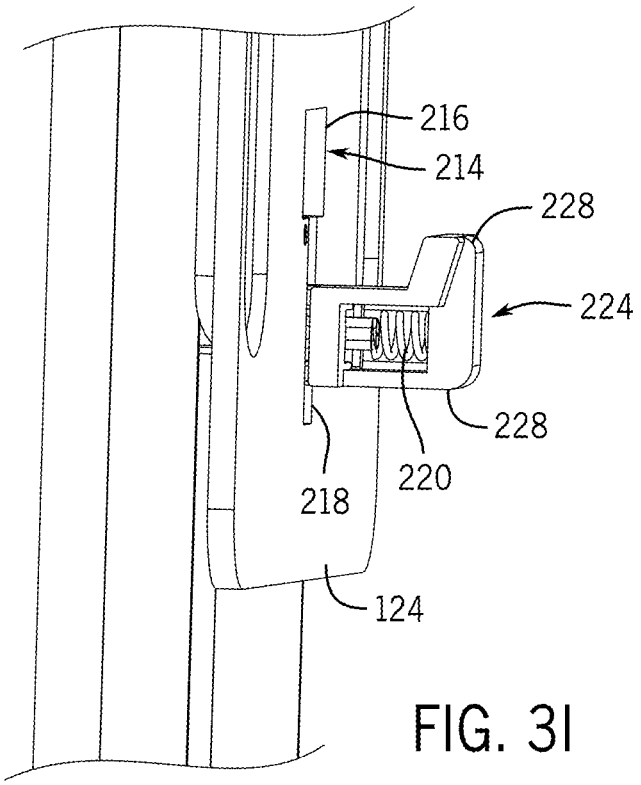
Figure 3J:
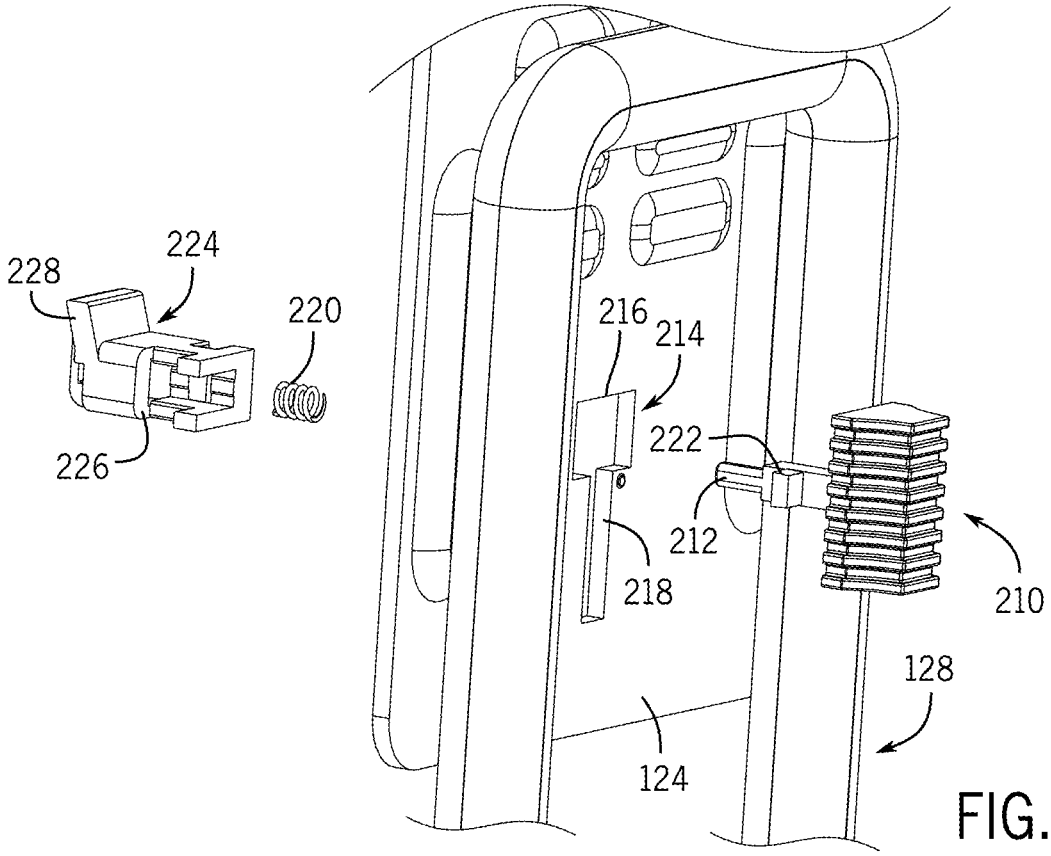
Figure 3K:
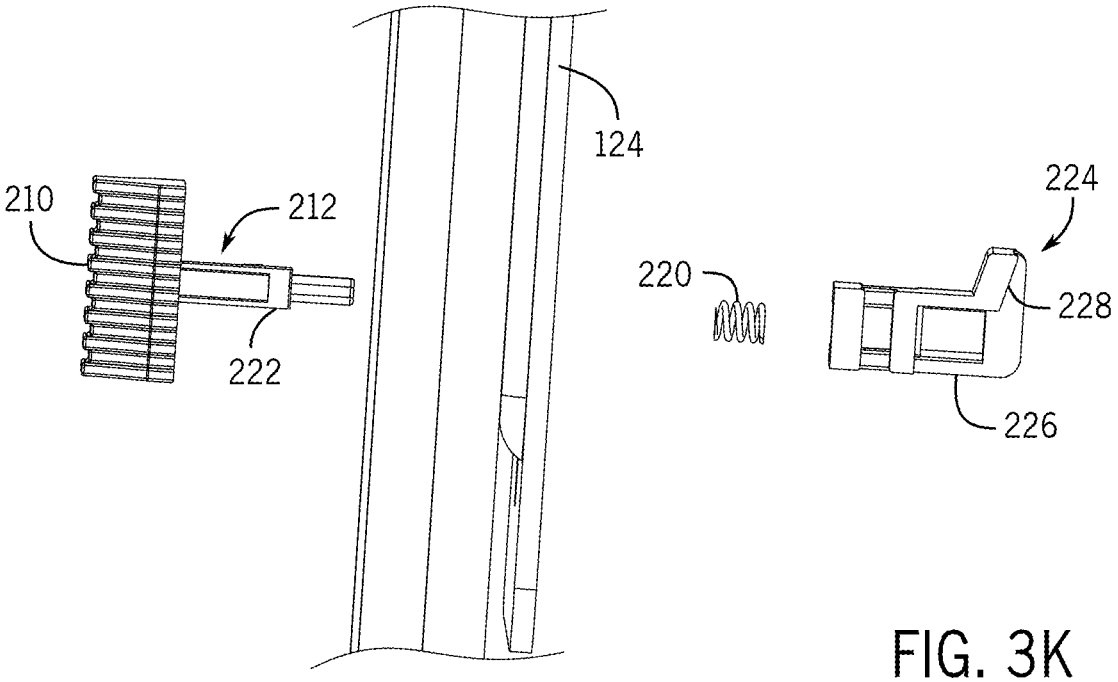
Figure 3L:
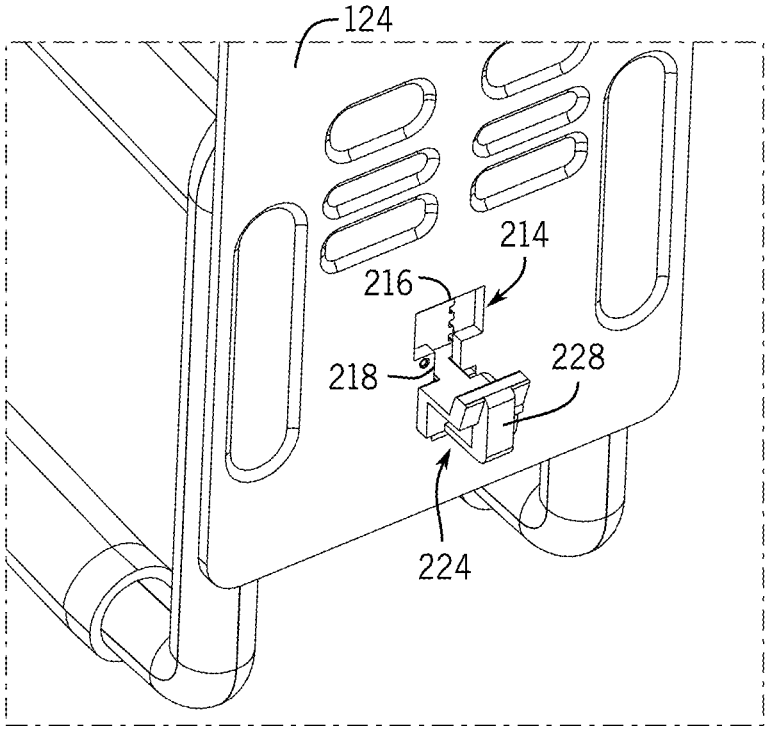

In operation, as best shown in FIGS. 3D, the locking flange 123 on the base plate 124 is engaged within a slot 102, the locking member 224 is positioned at least partially within a slot 102 at least partially covered by the base plate 124. The handle 210 is pressed against the base plate 124 to compress the spring 220 between the stop 222 and the body 226 and move the stop 222 out of engagement with the base plate 124, such that the locking mechanism 130', i.e., the handle 210, stem 212, and locking member 224, can slide along the narrow end 218 of the aperture 214. The movement of the handle 210 and stem 212 upwardly along the narrow lower end 218 locates the locking tab 228 within a lateral section 106 of the slot 102. The handle 210 is then released, allowing the spring 220 to press the stop 222 against the base plate 124 to lock the base plate 124 in the slot 102 against the panel 12. (FIGS. 3C-3D) The process is performed in reverse to move the locking tab 228 out of the lateral section 106 (FIG. 3B) and disengage the securing mechanism 130' form the panel 12, enabling the article holder 120 to be removed from the panel 12.

Figure 4A:
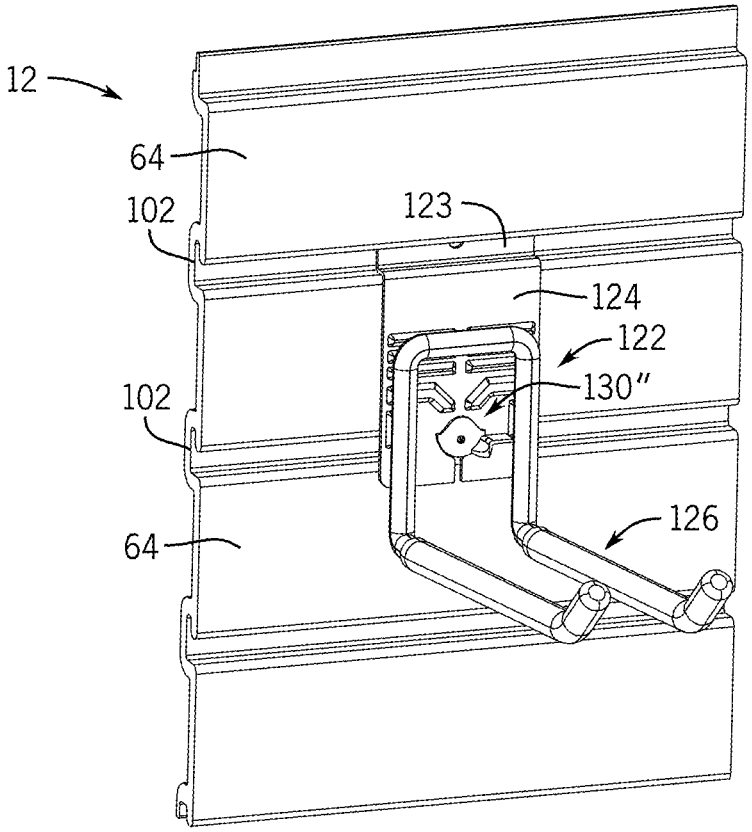
FIGS. 4A-4O are various views of a third embodiment of a locking mechanism for an article holder according to the present disclosure.
Figure 4B:
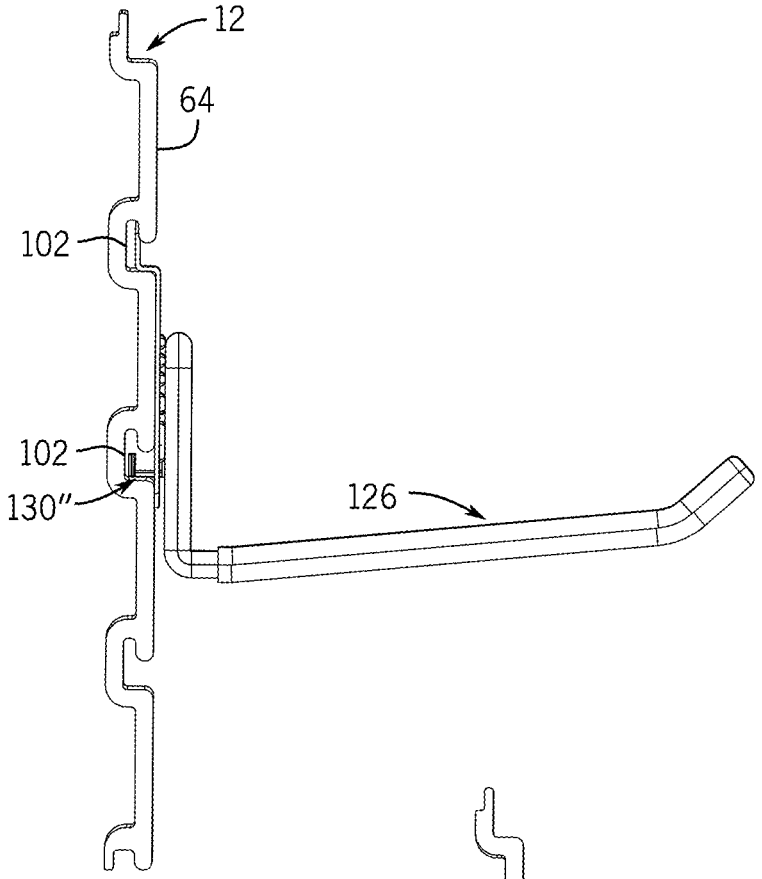
Figure 4C:
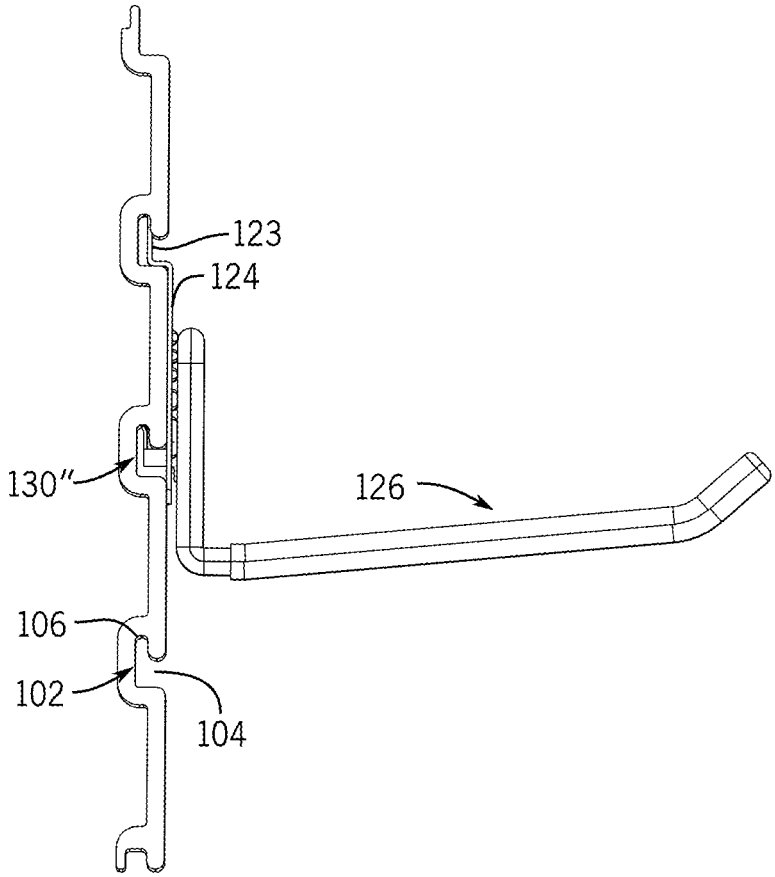
Figure 4D:
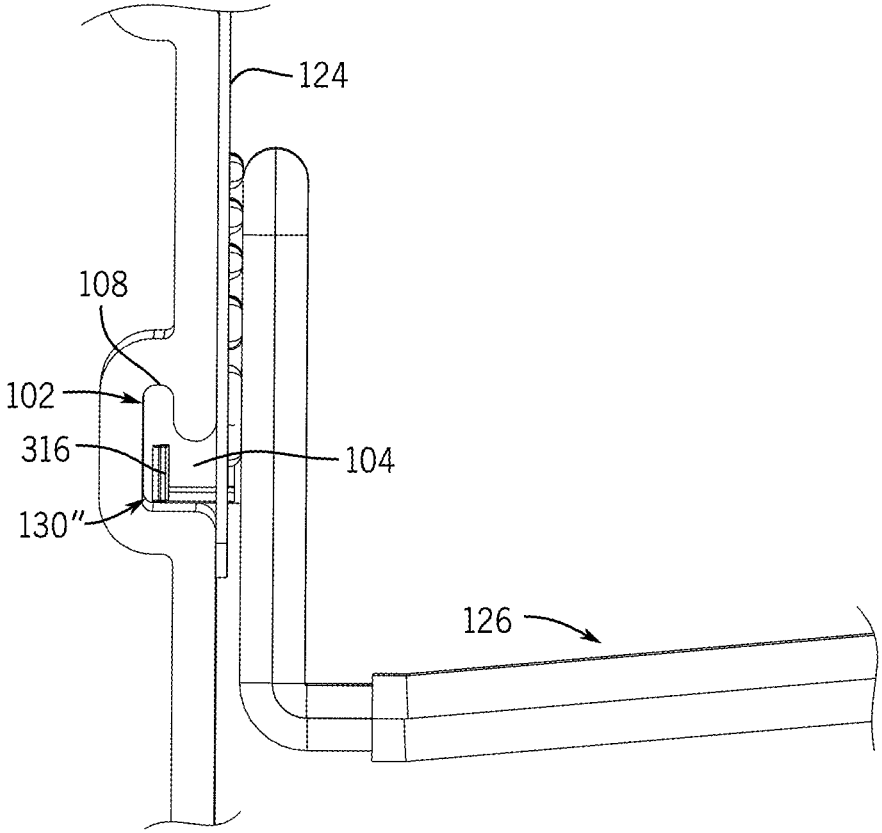
Figure 4E:
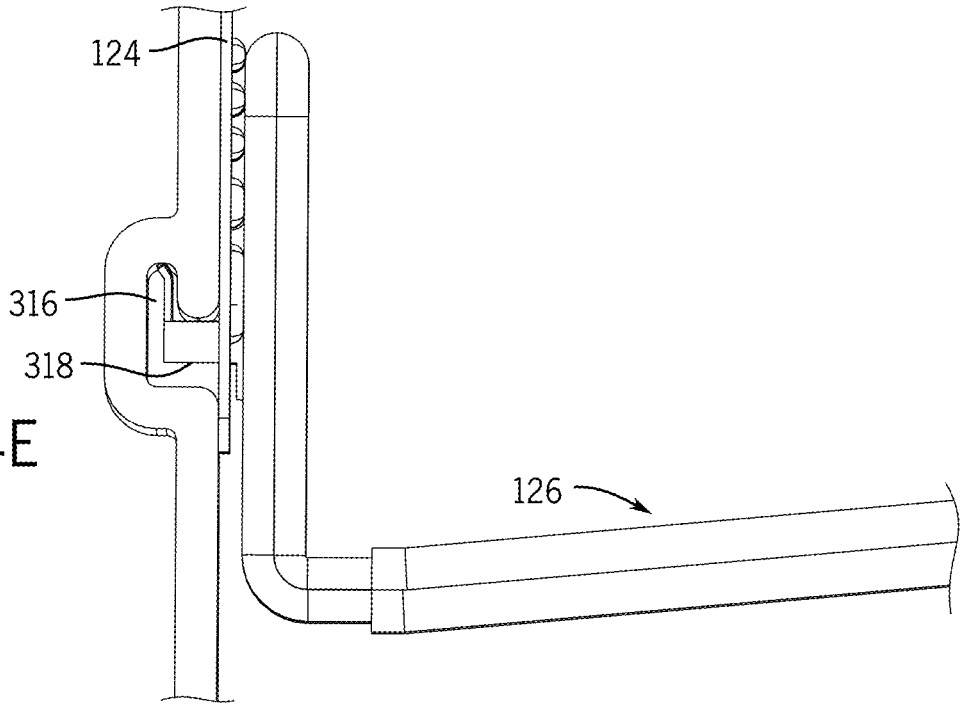
Figure 4F:
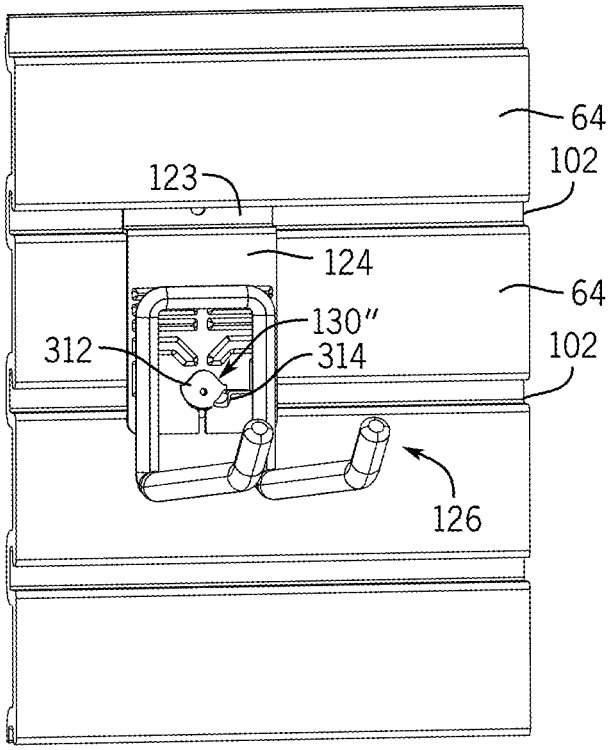
Figure 4G:
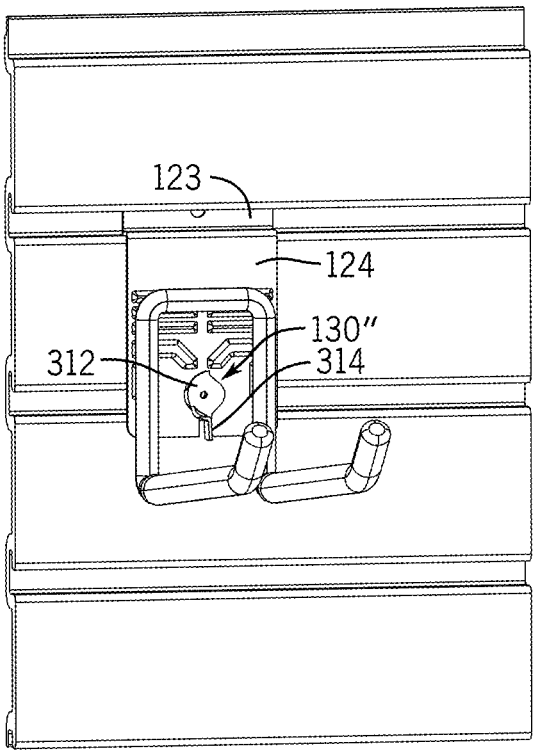
Figure 4K:
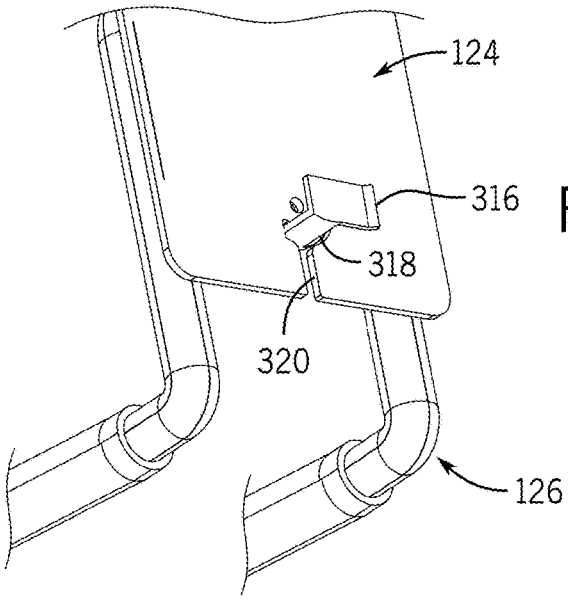
Figure 4L:
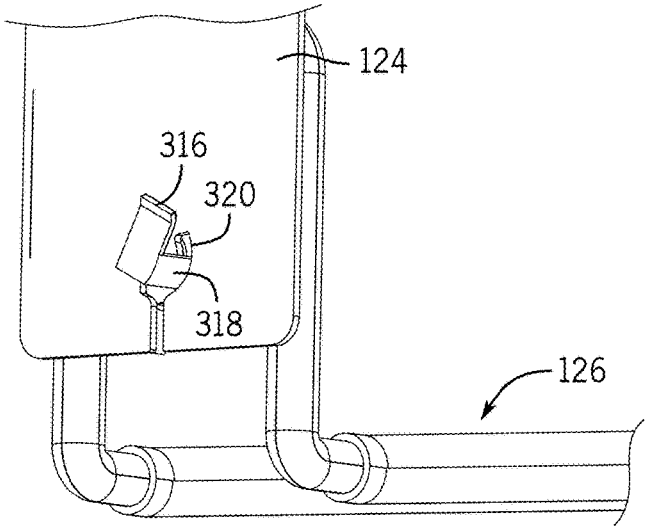
Figure 4M:
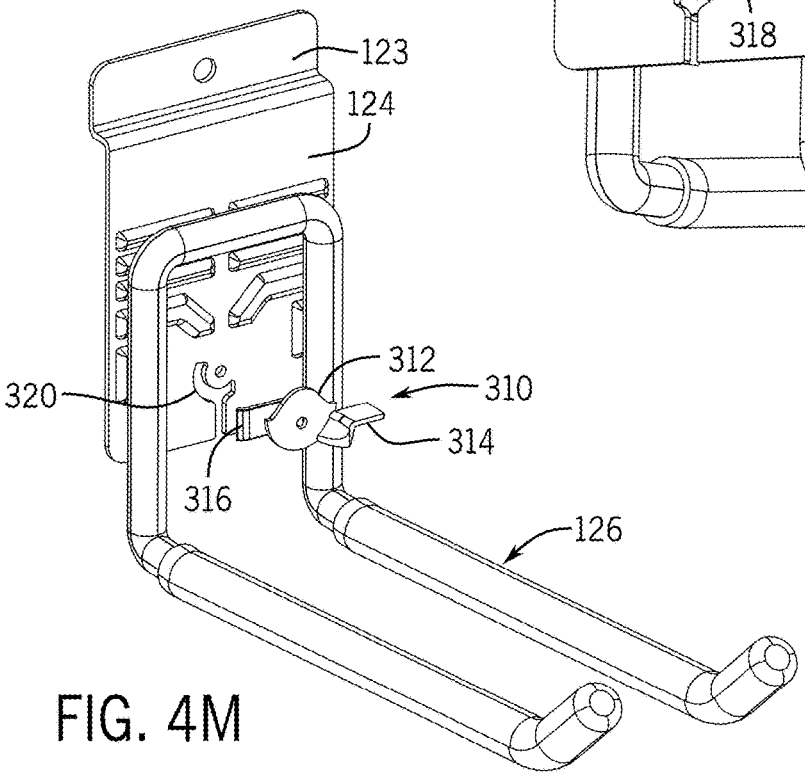
Figure 4N:
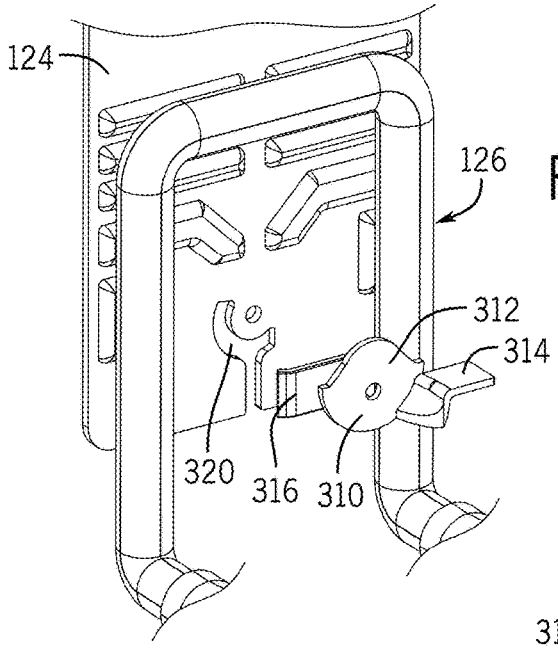
Figure 4O:
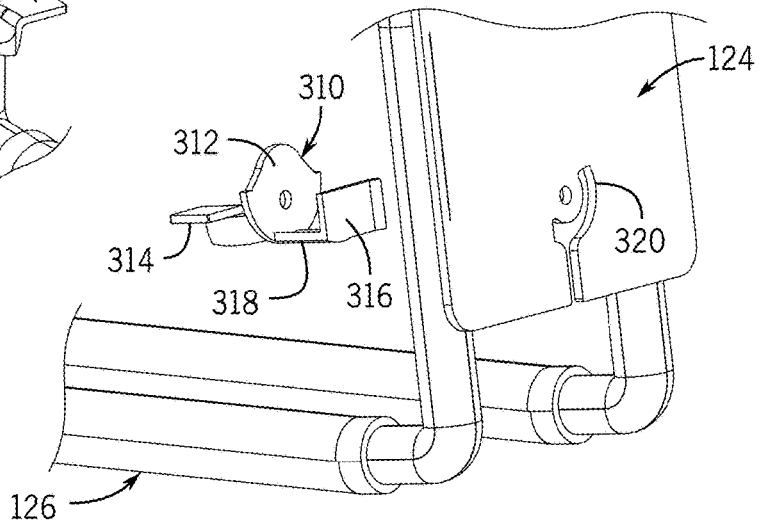

In still a further exemplary embodiment of the securing mechanism 130", as best shown in FIGS. 4A-4O, the locking mechanism 130" includes a rotating handle 310 pivotally mounted to the base plate 124. The handle 310 includes a body 312 pivotally secured to the base plate 124 via rivet or pin 313 rotatably positioned with a hole 317 in the base plate 124 (FIG. 41), a grip 314 extending outwardly from one side of the body 312, and a locking member 316 extending outwardly from the body 312 opposite the grip 314. The locking member 316 is connected to the body 312 by a spacer 318 that extends from the body 312 through a suitably formed slot 320 in the base plate 124 to enable the spacer 318, and thus the locking member 316, to move in conjunction with the body 312 when rotated using the grip 314. The grip 314 is formed to have a size that can be retained fully within the profile of the arm holder 127 and/or arms 128, as shown in FIGS. 4D and 4E, such that the grip 314 does not interfere with the placement of any articles on the arms 128.

In operation, with the grip 314 and locking member 316 oriented in a horizontally extending position (FIG. 41) the locking tab 123 of the base plate 124 is engaged within a slot 102 on the panel 12 and pivoted relative to the panel 12 in order to position the locking member 316 in a slot 102 at least partially covered by the base plate 124. Once the locking member 316 is disposed within the slot 102, the grip 314 can be rotated relative to the base plate 124 to move the locking member 316 from the horizontal position (FIG. 41) into a vertical position (FIG. 4J) to place the locking member 316 at least partially within a lateral section 106 of the slot 102. In this position, the base plate 124 cannot be removed from the panel 12 without first disengaging/rotating the locking member 316 out of the lateral section 106 of the slot 102.

Figure 5A:
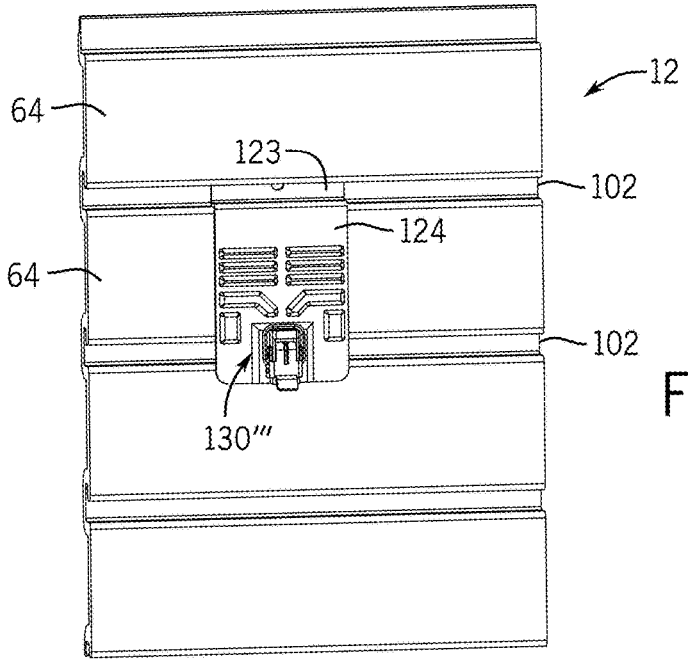
FIGS. 5A-5M are various views of a second embodiment of a locking mechanism for an article holder according to the present disclosure.
Figure 5B:
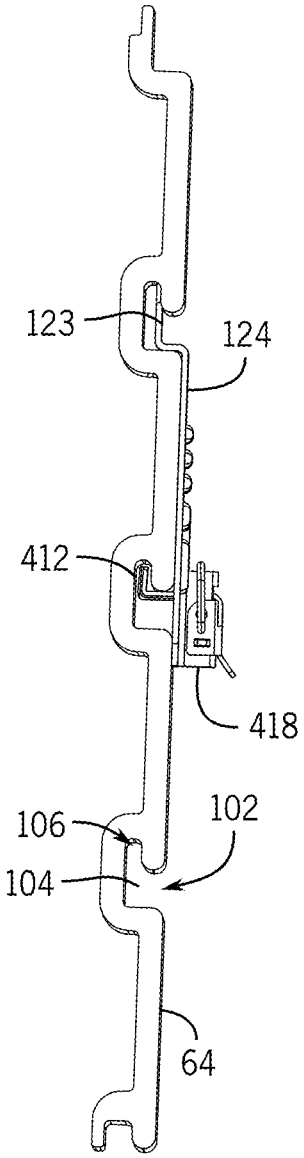
Figure 5C:
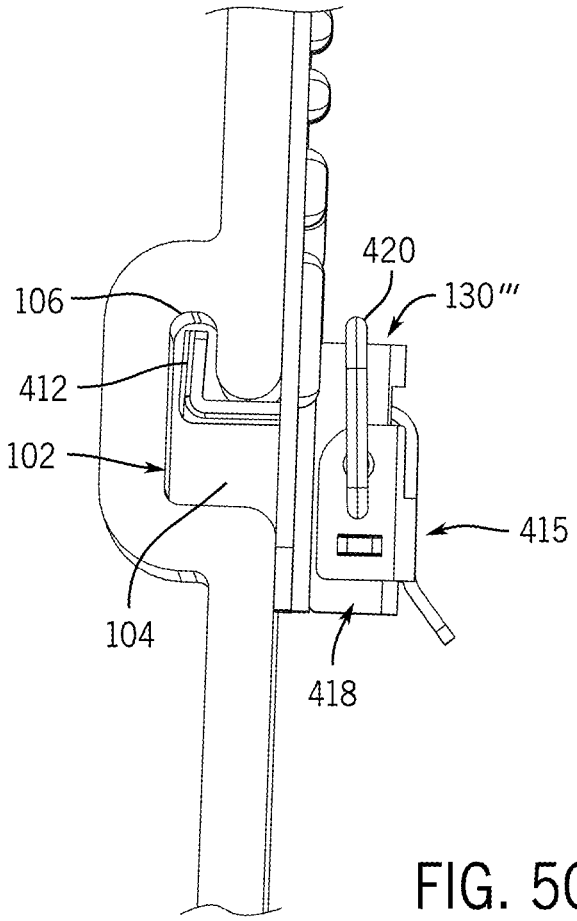
Figure 5D:
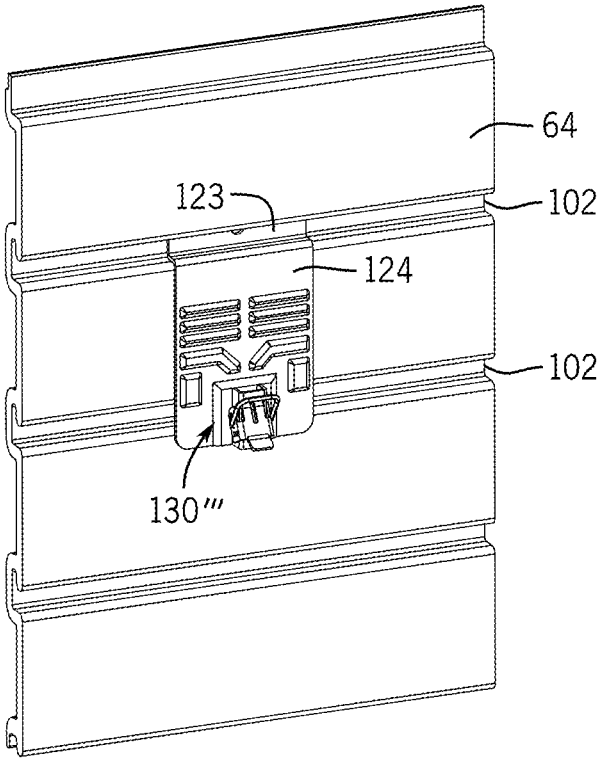
Figure 5E:
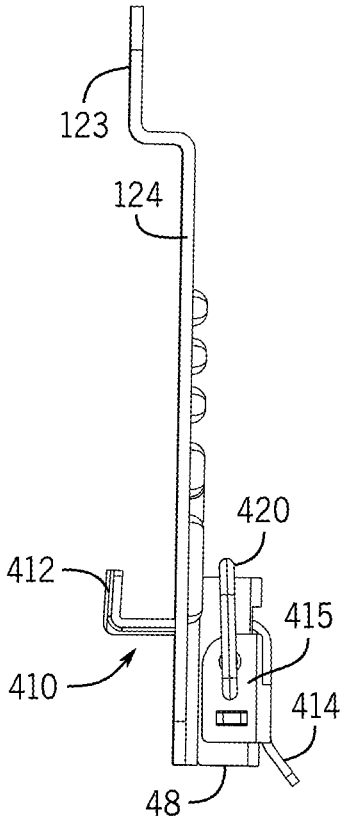
Figure 5F:
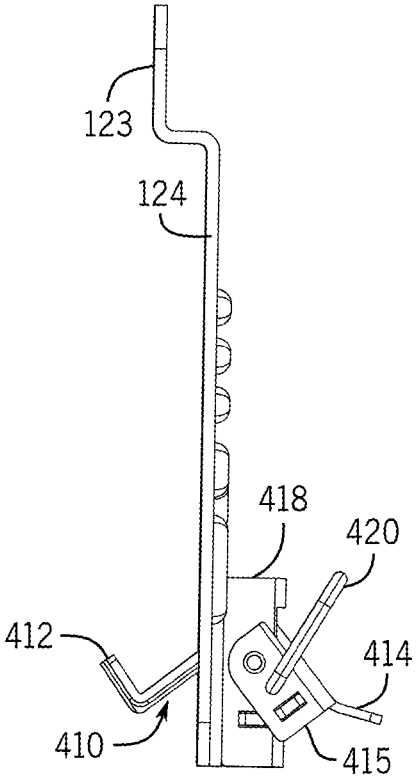
Figure 5G:
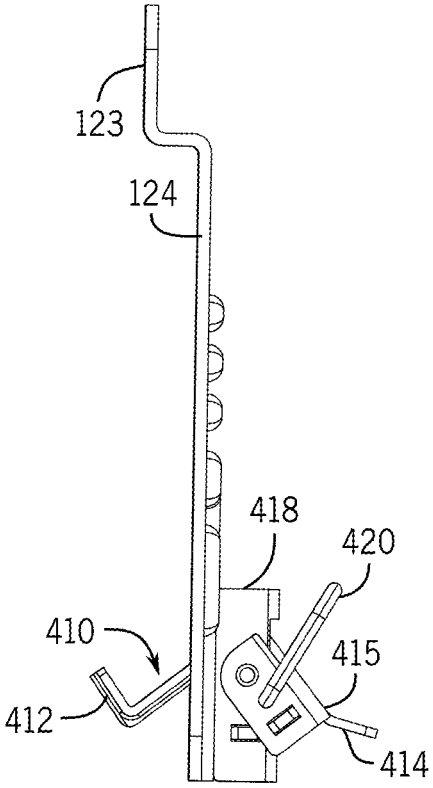
Figure 5H:
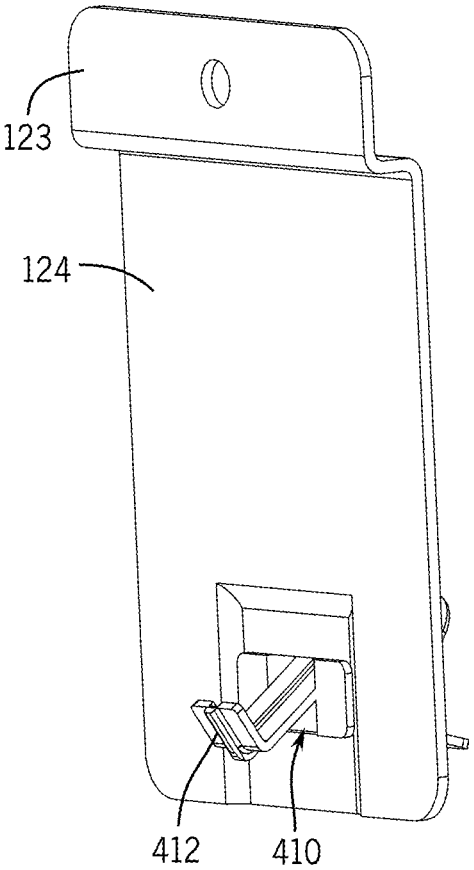
Figure 5I:
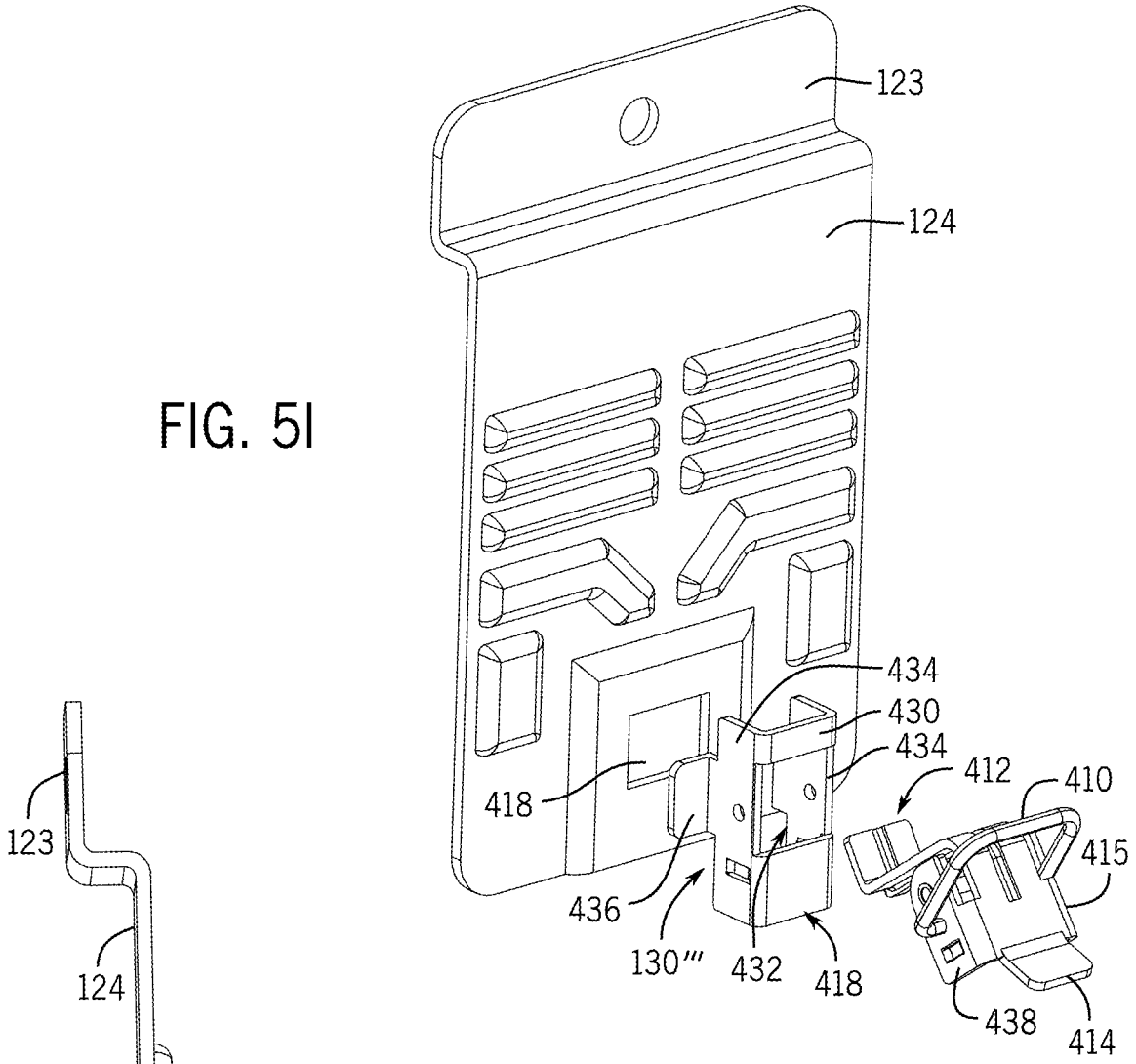
Figure 5J:
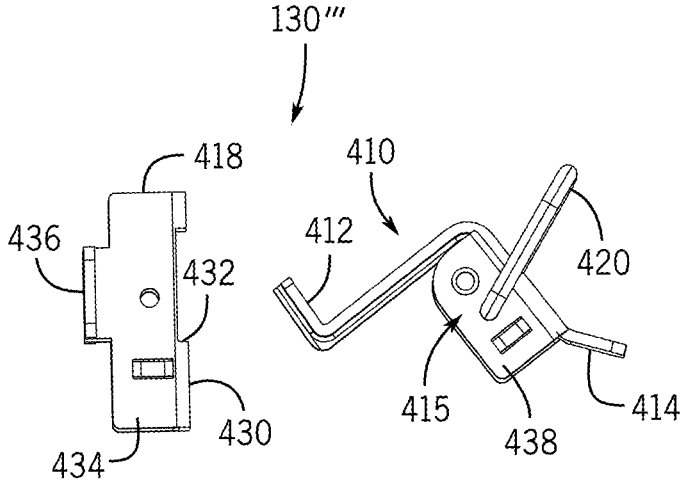

In still a further exemplary embodiment of the securing mechanism 130''' shown in FIGS. 5A-5M (the holding member 126 removed for clarity), the securing mechanism 130''' is formed similarly to the embodiment of FIGS. 2A-2J, with a locking plate 410 having a locking tab 412 at one end and an engagement flange 414 at the opposite end, the locking tab 412 and engagement plate 414 joined by a body 415 (FIG. 5I). The locking tab 412 extends through an aperture 416 in the base plate 124, and the body 415 is pivotally attached to a housing 418 disposed on and extending outwardly from the base plate 124. The housing 418, as best shown in FIGS. 5I-5J, include a central portion 430 defining an opening 432 therein. The housing 418 also includes a pair of side walls 434 extending outwardly from opposite sides of the central portion 430, each side wall 434 including a locking flange 436 opposite the central portion 430. The flanges 436 are inserted through the aperture 416 and engaged with the base plate 124 opposite the housing 418 to retain the housing 418 on the base plate 214 in alignment with the aperture 416.

As best shown in FIGS. 5I-5M, the body 415 also includes a pair of side panels 438 located on each side of the body 415. The side panels 438 are disposed adjacent the side walls 434 and are pivotally attached thereto such that the body 415 can pivot relative to the housing 418. A lock 420 is pivotally attached to the body 415, e.g., within bores (not shown) in the side panels 438, to allow the lock 420 to rotate with respect to the body 415.

In operation, when the housing 418 is secured to the base plate 124 and the body 415 rotatably secured to the housing 418, as shown in FIGS. 5E-5H, the locking tab 123 of the base plate 124 is engaged within a slot 102 on the panel 12 in order to pivot the base plate 124 into a position parallel to the panel 12 and position the locking tab 412 in a slot 102 at least partially covered by the base plate 124, as shown in FIG. 5C. Once the locking tab 412 is disposed within the slot 102 in the position shown in FIGS. 5F and 5H, the engagement flange 414 is pressed towards the housing 418 to pivot the locking tab 412 within a lateral section 106 of the slot 102 to secure the base plate 124 to the panel 12. In this position, as best shown in FIGS. 5E and 5L, the body 415 is positioned against the housing 418, and the engagement flange 414 extends outwardly from the body 415 to define a gap 440 between the flange 414 and the housing 418.

Figure 5M:
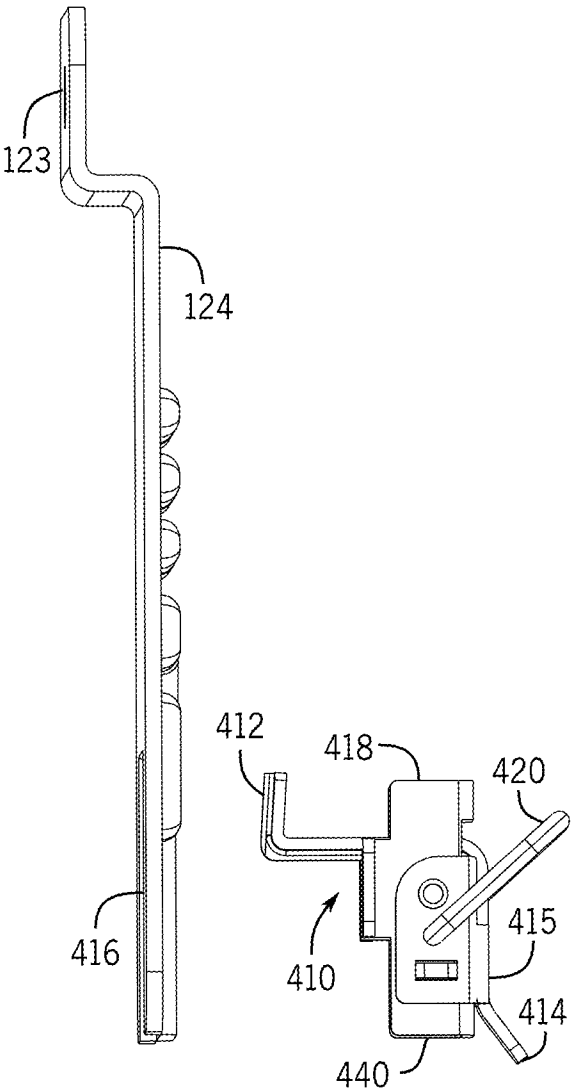
Figure 5L:
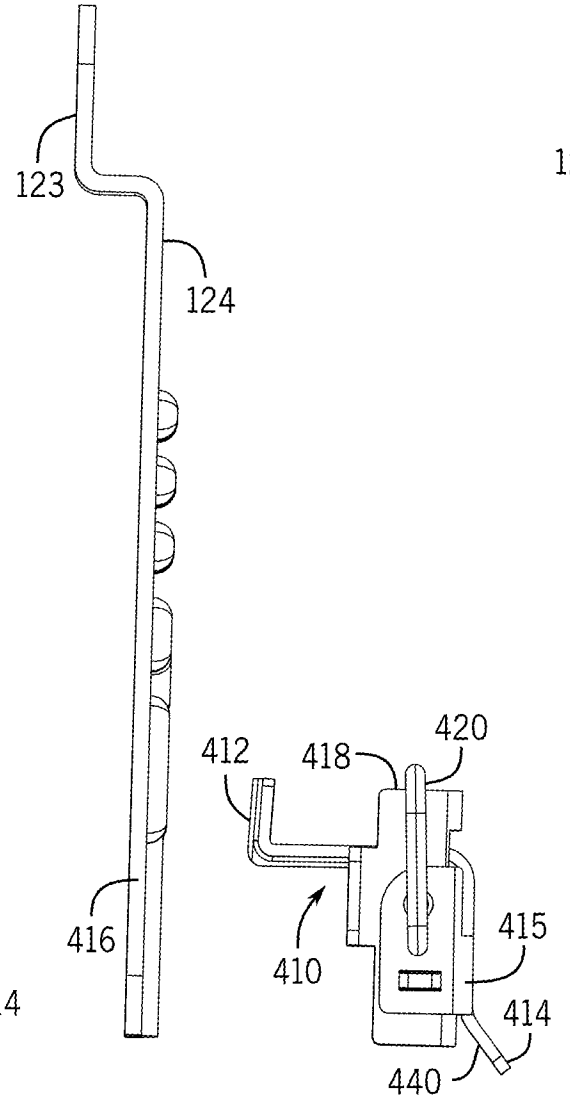
Figure 5K:
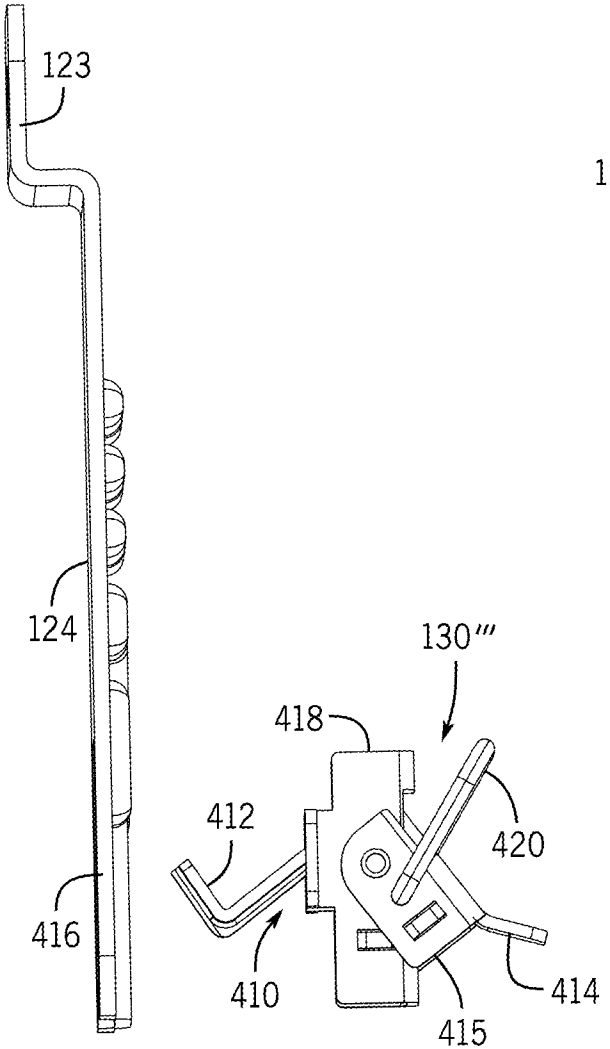

To maintain the securing mechanism 130''' in this position, the lock 420 can be pivoted to the position in FIG. 5L where the lock 420 extends around the housing 418 between opposed side panels 438 of the body 415. In this position, when the flange 414 is grasped and pulled away from the housing 415, the lock 420 engages the housing 418 to prevent movement of the body 415 away from the housing 418. Only when the lock 420 is disengaged, e.g., by pivoting the lock 420 into a position over the body 415, such as shown in FIG. 5M, can the flange 414 be grasped using the gap 440 to pivot the body 415 away from the housing 418 to move the locking tab 412 out of the lateral section 106 of the slot 102, allowing the article holder 120 to be removed from the panel 12.

Looking now at FIGS. 6A-6K, an alignment device or hidden fastener system 500 is shown that is used to align the vertical mounting members 502 on the wall in order to position the mounting members 502 in the desired horizontal position prior to mounting the panels 12 thereon. As best shown in FIGS. 6C-6F, the alignment device 500 in the illustrated exemplary embodiment is formed of a number of vertical elongate members 502 having a number of outwardly extending tabs 504 disposed thereon. In the exemplary illustrated embodiment of FIG. 6J, the tabs 504 are formed as an upper tab 520 that extends downwardly from the elongate member 502 and a lower tab 522 spaced from the upper tab 520 and extending upwardly from the elongate member 502. The tabs 520,522 define an enclosure 524 between the tabs 520,522 and the elongate member 502 with a slot 526 separating the tabs 520 at their adjacent ends. The vertical members 502 are spaced from one another aligned to position the tabs 504 on each vertical member 502 in alignment with one another.

The alignment of the tabs 504, and thus the vertical members 502, can be checked through the use of a number of horizontal members 506 which each include an elongate horizontal plate 508. The plates 508 are engaged with the tabs 504 by inserting the plates though the enclosures 524 defined by the upper and lower tabs 520,522. Further, an alignment flange 510 extends outwardly from the plate 508 along its length and that can be positioned within and extend through the slot 526. Thus, when the horizontal elongate members 506 are engaged with the vertical elongate members 502, the engagement of the plates 508 within the enclosures 524 and through the slot 526 provides a perpendicular orientation for the vertical members 502 and the horizontal members 506 when properly aligned.

Figure 6G:
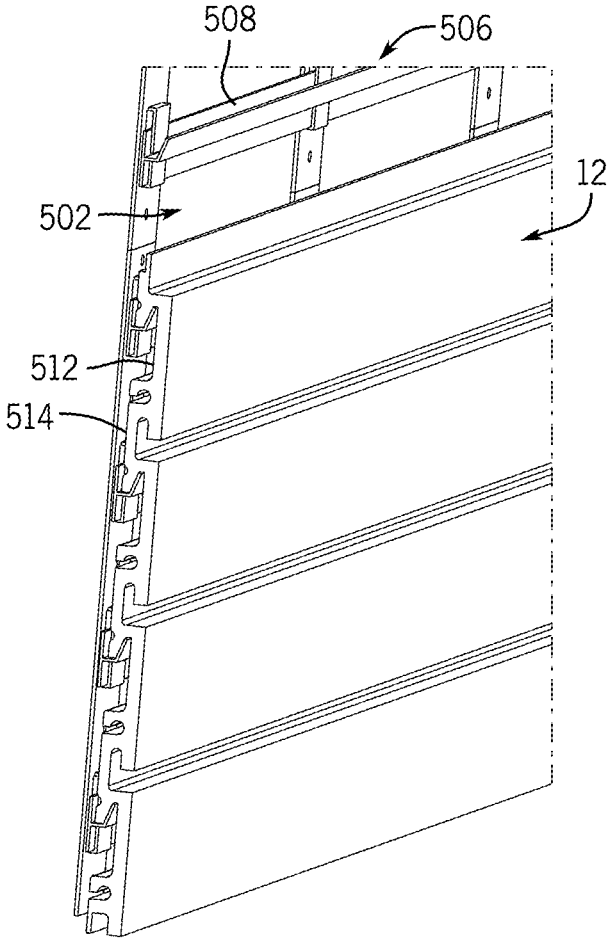
Figure 6H:
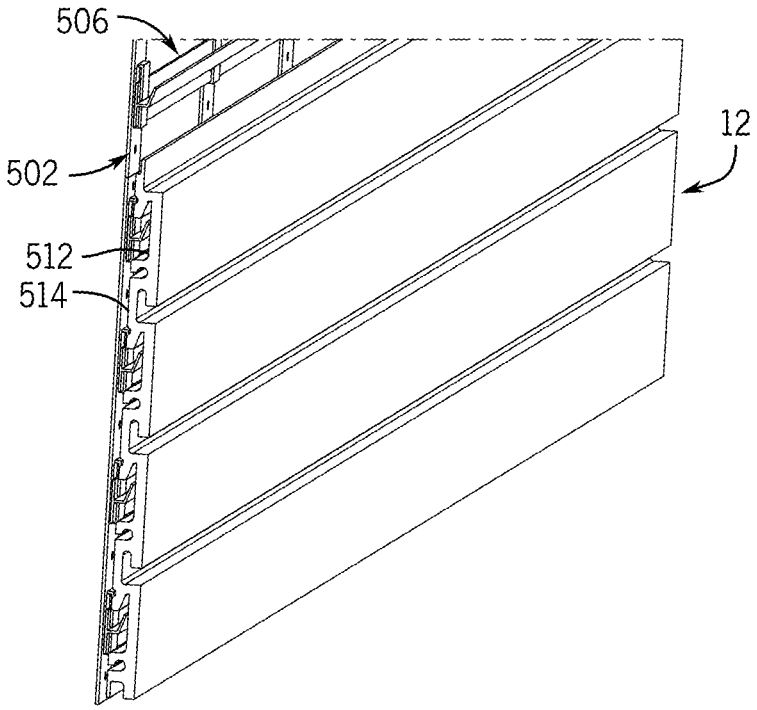
Figure 6I:
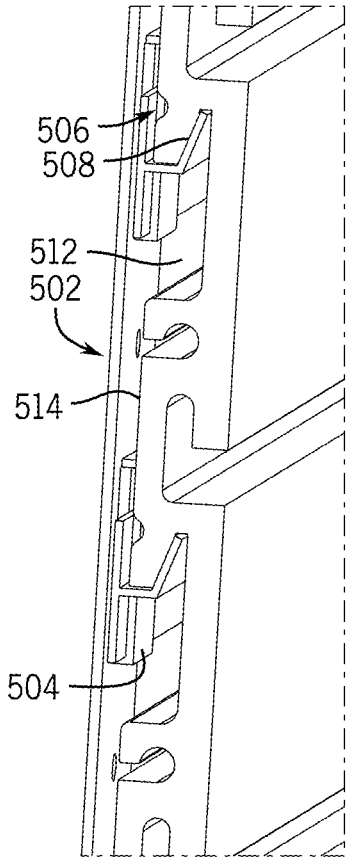
Figure 6J:
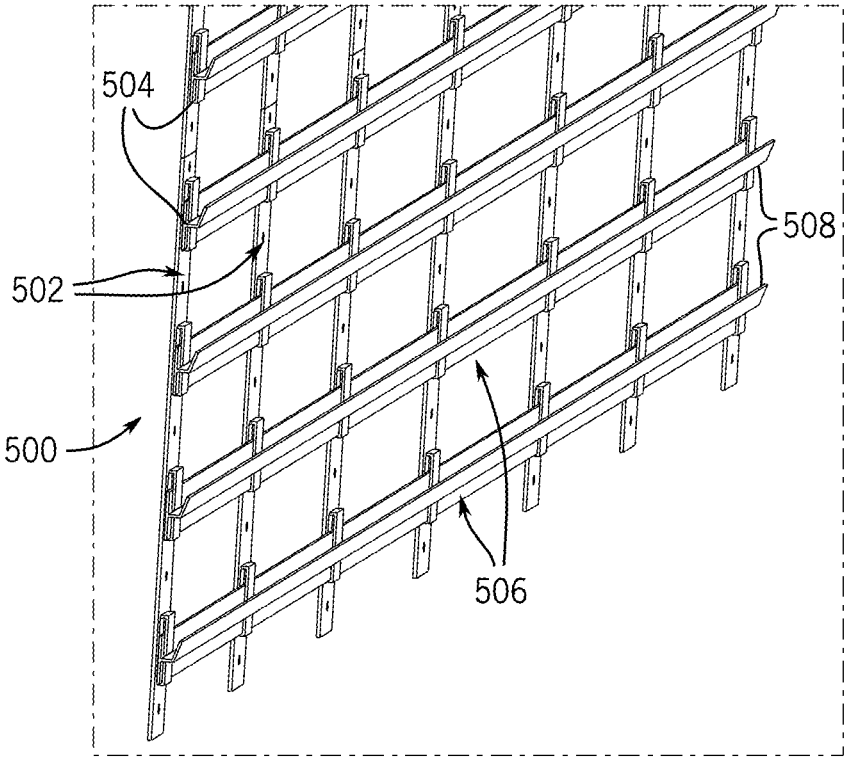
Figure 6K:
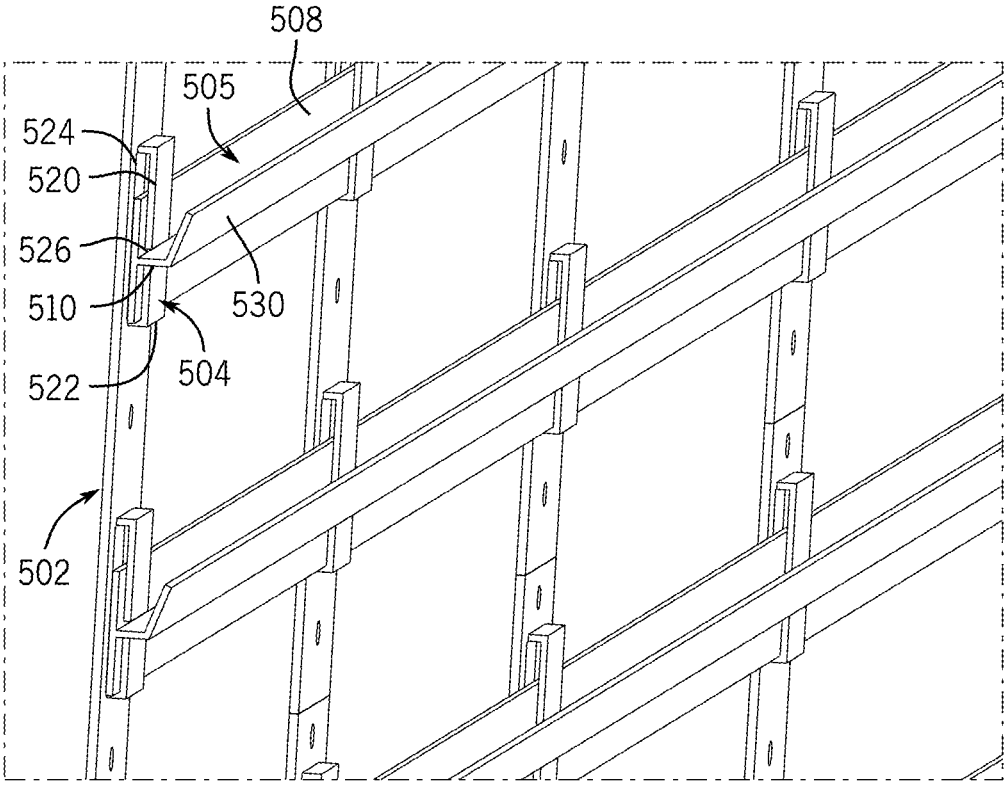

Further, the horizontal members 506 include mounting flanges 530 that extend outwardly from the alignment flange 510 opposite the plates 508 and that are spaced to engage mounting slots 512 disposed in the rear surface 514 of the slatwall panels 12 opposite the slots 102, as best shown in FIGS. 6G-6I. After alignment of the vertical member 502 and horizontal member 506 with one another on the wall, the panels 12 can be engaged with the horizontal members 506 to secure the panels 12 to the wall. This hidden fastener system/alignment device 500 provides a seamless, level installation, minimizing installation errors and enhancing the overall aesthetic. Further, the alignment device 500 allows for efficient, precise installation of the wall storage system 10, making it adaptable for various layouts and configurations.

Various other embodiments of the present invention are contemplated as being within the scope of the following claims particularly pointing out and distinctly claiming the subject matter regarded as the invention.

I claim:

1. A wall storage system comprising:

a) at least one wall panel adapted to be secured to a wall surface, the at least one wall panel including a first slot and a second slot spaced from the first slot; and b) an article holder comprising:

i) a base panel releasably engageable with the first slot; and ii) a securing mechanism disposed on the base panel and engageable with the second slot to secure the article holder to the at least one wall panel wherein the securing mechanism includes a locking tab releasably engageable within the second slot formed in the at least one wall panel, wherein the locking tab is rotatably mounted to the base panel, and wherein the securing mechanism comprises:

a) a housing mounted to the base panel;

b) a body pivotally mounted to the housing, the locking tab extending outwardly from the body extending through an aperture in the base panel.

2. The wall storage system of claim 1, wherein the securing mechanism further comprises a lock pivotally secured to the body and releasably engageable with the housing.

3. The wall storage system of claim 1, wherein the body further comprises an engagement flange opposite the locking tab.

4. A wall storage system comprising:

a) at least one wall panel adapted to be secured to a wall surface, the at least one wall panel including a first slot and a second slot spaced from the first slot; and b) an article holder comprising:

i) a base panel releasably engageable with the first slot; and ii) a securing mechanism disposed on the base panel and engageable with the second slot to secure the article holder to the at least one wall panel wherein the securing mechanism includes a locking tab releasably engageable within the second slot formed in the at least one wall panel, and wherein the securing mechanism further comprises:

a) an aperture in the base panel having a wide upper end and a narrow lower end; and b) a handle including a stem having a lock thereon, the stem extending through an aperture in the base panel into engagement with the locking tab.

5. The wall storage system of claim 4, further comprising a spring within the locking tab and engaged with the lock around the stem to bias the lock into engagement with the base panel.

6. The wall storage system of claim 5, wherein the locking tab is slidable with respect to the narrow lower end of the aperture in the base panel.

* * * * *